US011459141B1

(12) United States Patent
Kaldahl

(10) Patent No.: US 11,459,141 B1
(45) **Date of Patent: *Oct. 4, 2022**

(54) AMMUNITION CONTAINER INCLUDING STACKING FOOT AND RECESS ARRANGEMENT

(71) Applicant: Jeffrey W. Kaldahl, Denver, CO (US)

(72) Inventor: Jeffrey W. Kaldahl, Denver, CO (US)

(73) Assignee: Jeffrey W. Kaldahl, Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/860,763

(22) Filed: Apr. 28, 2020

Related U.S. Application Data

(63) Continuation-in-part of application No. 15/668,343, filed on Aug. 3, 2017, now Pat. No. 10,676,241.

(51) Int. Cl.
*F42B 39/24* (2006.01)
*B65D 1/24* (2006.01)
*F42B 39/26* (2006.01)

(52) U.S. Cl.
CPC ..... *B65D 1/24* (2013.01); *F42B 39/26* (2013.01); *B65D 2543/00027* (2013.01); *B65D 2543/00296* (2013.01)

(58) Field of Classification Search
CPC ..... B65D 25/04; B65D 25/2858; B65D 2525/286; B65D 2571/00512; B65D 1/24; B65D 1/36; B65D 5/48; B65D 7/065; B65D 21/0217; B65D 21/0219; B65D 21/022; B65D 21/0222; B65D 21/0223; B65D 21/023; F42B 39/26; A45C 201/267
USPC ..... 220/529, 524, 500, 553, 752, 757, 761, 220/763, 770, 775, 773; 206/508, 511
See application file for complete search history.

(56) References Cited

U.S. PATENT DOCUMENTS 4,632,888 A * 12/1986 Kump ..... H01M 50/256 429/187
4,819,795 A * 4/1989 Swaney ..... B65D 21/0222 206/278
8,479,947 B1 * 7/2013 Albrecht, II ..... A45C 11/20 220/592.02
2001/0035416 A1 * 11/2001 Dodson ..... A47K 10/421 220/524
2002/0053529 A1 * 5/2002 White ..... B65D 21/0223 206/425

* cited by examiner

*Primary Examiner* — Robert Poon
(74) *Attorney, Agent, or Firm* — Polsinelli PC; David R. Mika

(57) ABSTRACT

Stackable ammunition containers include movable lids defining recesses within which feet of another ammunition container may be inserted. The feet and recesses may have specific dimensions and positions to balance between retention of the feet within the recesses to provide structural stability when stacked and ease of unstacking.

17 Claims, 15 Drawing Sheets

AMMUNITION CONTAINER INCLUDING STACKING FOOT AND RECESS ARRANGEMENT

CROSS-REFERENCE TO RELATED APPLICATION

This non-provisional utility application is a continuation-in-part of U.S. patent application Ser. No. 15/668,343, filed Aug. 3, 2017, and titled "AMMUNITION CONTAINER", the entire contents of which are incorporated herein by reference for all purposes.

TECHNICAL FIELD

Aspects of the present disclosure relate to ammunition containers, and more particularly to a multi-compartment ammunition container.

BACKGROUND

Proper transportation and storage of ammunition is an important component of general firearm safety. For example, improper organization of stored ammunition may contribute to a shooter selecting a round from a container having a different bullet type, caliber, or a higher load than expected, each of which may in turn lead to misfires, damage to the firearm being used, harm to the shooter, and unexpected ballistic behavior. Ammunition containers must also securely store ammunition and allow for easy handling to reduce the likelihood of inadvertent spilling of or access to the ammunition stored within.

It is with these observations in mind, among others, that aspects of the present disclosure were conceived.

SUMMARY

In one aspect of the present disclosure, an ammunition container comprising is provided. The ammunition container includes multiple compartment portions, each of which includes an independently movable lid. The compartment portions collectively define a first surface of the ammunition container and, when closed, the independently movable lids collectively define a second surface of the ammunition container. The ammunition container further includes a recess extends from the second surface of the ammunition container below the top surface of the ammunition container and into the lid and a foot protruding from the first surface. The recess is shaped and positioned such that a foot of a second ammunition container is receivable within the recess when the second ammunition container is stacked on the ammunition container.

In another aspect of the present disclosure, another ammunition container is provided. The ammunition container includes a first compartment portion including a first compartment having a first compartment bottom, a first foot extending from the first compartment bottom, and a first movable lid coupled to the first compartment and defining a first recess extending into the first movable lid. The ammunition container further includes a second compartment portion adjacent the first compartment portion. The second compartment portion includes a second compartment comprising a second compartment bottom, a second foot extending from the second compartment bottom, and a second movable lid coupled to the second compartment and defining a second recess extending into the second movable lid. Each of the first foot and the second foot has a shape receivable by at least one of the first recess and the second recess. Each of the first recess and the second recess are further shaped and positioned such that a first foot of a second ammunition container is receivable by one of the first recess and the second recess of the ammunition container and a second foot of the second ammunition container is receivable by the other of the first recess and the second recess of the ammunition container when the second ammunition container is stacked on the ammunition container.

In still another aspect of the present disclosure, yet another ammunition container is provided. The ammunition container includes a first compartment portion having a first movable lid and a second compartment portion adjacent to and coupled to the first compartment portion, the second compartment portion having a second movable lid. The ammunition container further includes a plurality of L-shaped feet extending from a bottom of the ammunition container. The first movable lid and the second movable lid define a substantially rectangular surface of the ammunition container having an outer extent and defining a plurality of L-shaped recesses. The first movable lid includes a first and a second corner of the surface and the second movable lid includes a third and fourth corner of the surface. The first movable lid defines a first L-shaped recess of the plurality of L-shaped recesses disposed in the first corner and a second L-shaped recess of the plurality of L-shaped recesses disposed in the second corner, each of the first L-shaped recess and the second L-shaped recess being disposed within the outer extent of the surface and extending into the first movable lid. The second movable lid defines a third L-shaped recess of the plurality of L-shaped recesses disposed in the third corner and a fourth L-shaped recess of the plurality of L-shaped recesses disposed in the fourth corner, each of the third L-shaped recess and the fourth L-shaped recess disposed within the outer extent of the surface and extending into the second movable lid. Each of the plurality of L-shaped feet are shaped and positioned such that each of a plurality of L-shaped feet of a second ammunition container is receivable within a respective one of plurality of L-shaped recesses when the second ammunition container is stacked on the ammunition container.

BRIEF DESCRIPTION OF THE DRAWINGS

The above-recited and other advantages and features of the disclosure will become apparent by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Aspects of the present disclosure involve ammunition containers (also commonly referred to as "ammunition/ammo boxes" or "dry boxes"), including multiple compartments, each of which may be used to store different types of ammunition or shooting accessories. Ammunition containers in accordance with this disclosure may include two compartments, each of which having an individual lid that may be opened, closed, and secured independently of the lid of the other compartment. Other implementations may include more than two compartments. For example, an ammunition container may include four compartments with four corresponding lids. In such implementations, each compartment may have a separate lid. Alternatively, lids may be shared between adjacent compartments. For example, a given compartment may be subdivided into two portions with a lid providing access to both portions. As a result, organization of the ammunition and accessories within the ammunition container are improved.

Ammunition containers in accordance with the present disclosure also include handles adapted to be moved between positions depending on whether the ammunition containers are being transported or stored. For example, in one implementation, a sliding handle is included that may be extended into a first position to facilitate carrying of the ammunition container but retracted into a second position in which the handle does not interfere with other ammunition containers that may be stacked on top of the ammunition container. In certain implementations, the sliding handle does not interfere with the lids of the compartments such that the lids may be opened and closed regardless of whether the sliding handle is extended or retracted. In other implementations, a rotating handle is included that may be folded up to facilitate carrying but can be rotated into a downward position in which the handle is disposed in a recess of an adjacent lid. Again, this allows stacking of other ammunition containers without interference from the handle.

Other features of ammunition containers in accordance with this disclosure are directed to stacking ammunition containers. For example, in certain implementations, lids of the ammunition container include recesses shaped to receive and positively engage corresponding feet of another ammunition container. As a result multiple ammunition containers may be securely stacked on top of each other for ease of storage and transportation.

Figure 1:
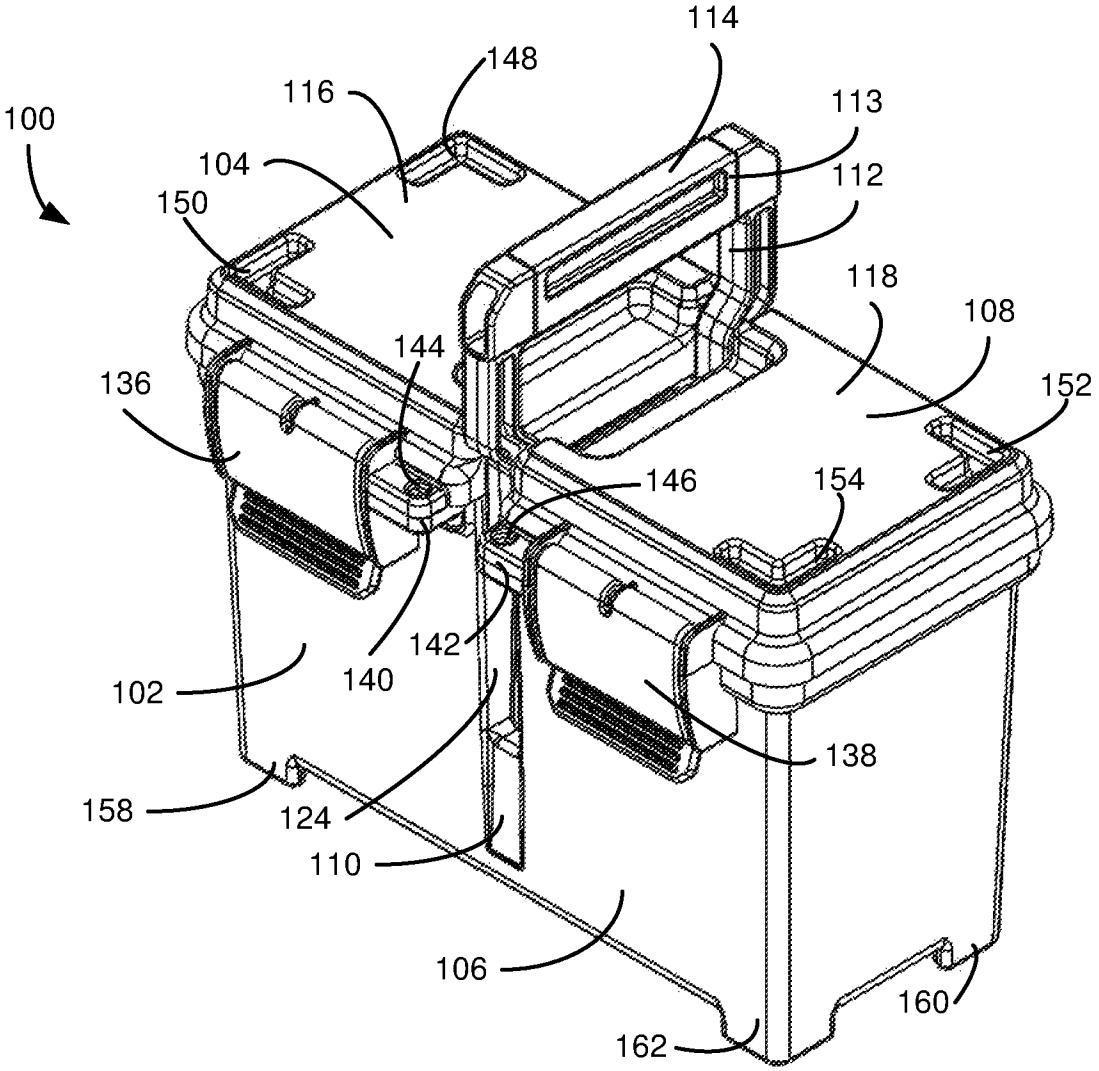
FIG. 1 is an isometric view of a first ammunition container with a handle in an extended position.
Figure 2:
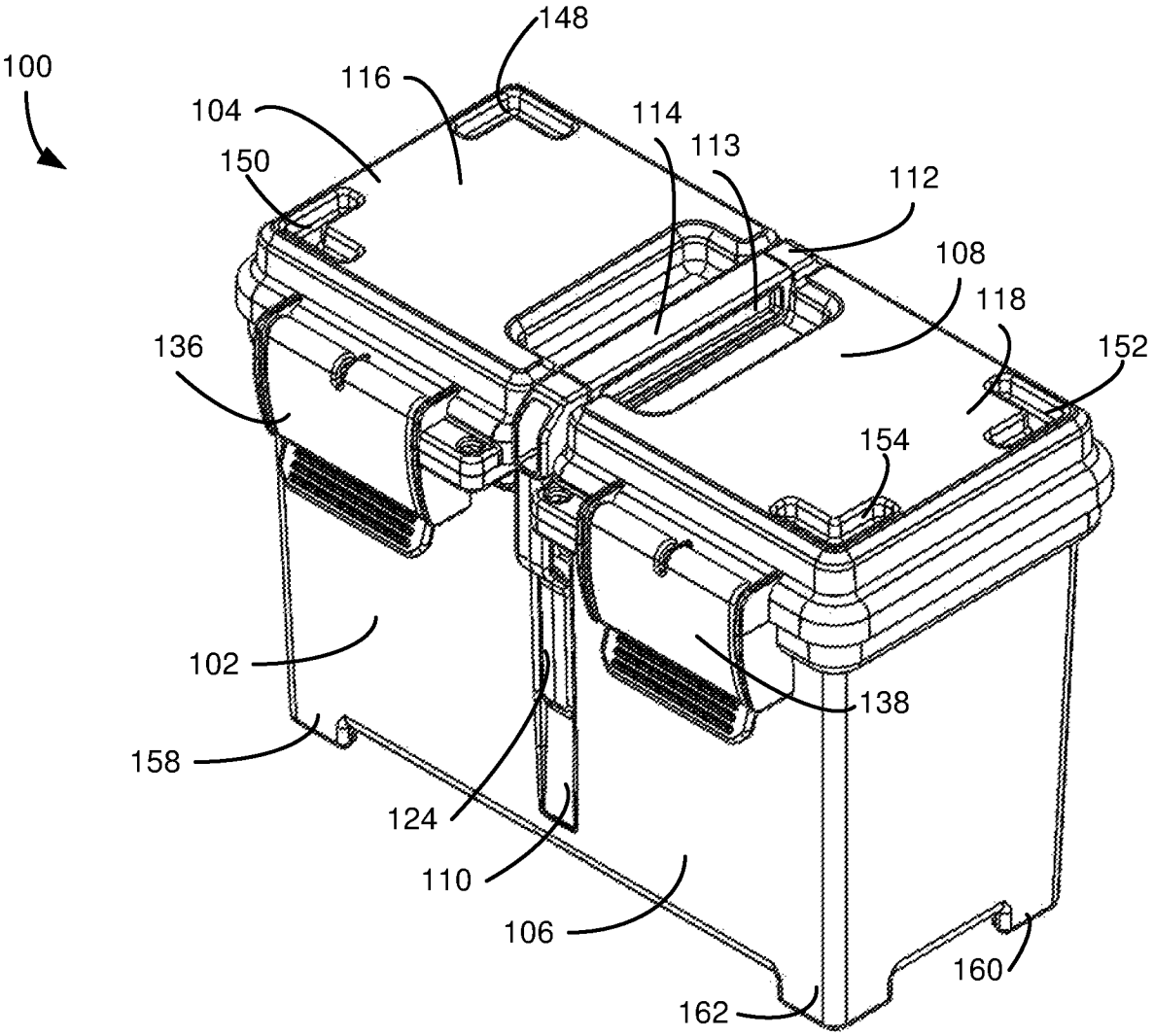
FIG. 2 is an isometric view of the ammunition container of FIG. 1 with the handle in a retracted position.

FIGS. 1 and 2 are isometric views of a first ammunition container 100 according to the present disclosure in an extended and retracted configuration, respectively. The ammunition container 100 includes two adjacent compartments 102, 106, each having respective lids 104, 108. The lids 104, 108 are coupled to their respective compartments 102, 106 such that each lid 104, 108 may be opened and closed independently.

The compartments 102, 106 are adjoined by a divider 110 to which a handle 112 is coupled. As illustrated, the ammunition container 100 is substantially symmetrical about the divider 110 such that the first compartment 102 and the first lid 104 are reflective of the second compartment 106 and the second lid 108. In other implementations, the compartments 104, 106 may be different shapes and sizes or may include different structural features. A top portion 113 of the handle 112 extends between the compartments 102, 106 parallel to the divider 110. The handle 112 is coupled to the divider 110 such that the handle 112 may be selectively extended and retracted. FIG. 1, for example, illustrates the handle 112 in an extended position while FIG. 2 illustrates the handle 112 in the retracted position.

When the handle 112 is in the retracted position, a top surface 114 of the top portion 113 of the handle 112 is flush with or below top surfaces 116, 118 of the lids 104, 108. Accordingly, other items, including other ammunition containers in accordance with this disclosure, may be readily stacked on top of the ammunition container 100. To facilitate extension of the handle 112 from the retracted position, each of the lids 104, 108 may define grooves or cutouts such that the handle 112 may be readily grasped while in the retracted position.

Figure 3:
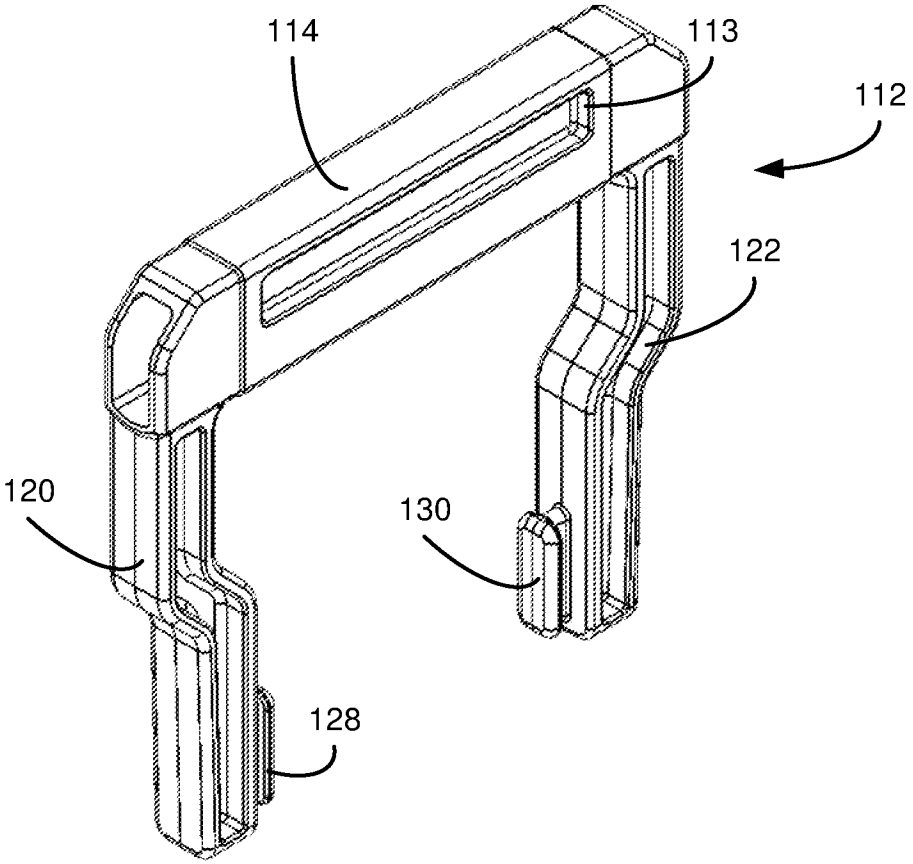
FIG. 3 is an isometric view of the handle of the ammunition container of FIG. 1.
Figure 4:
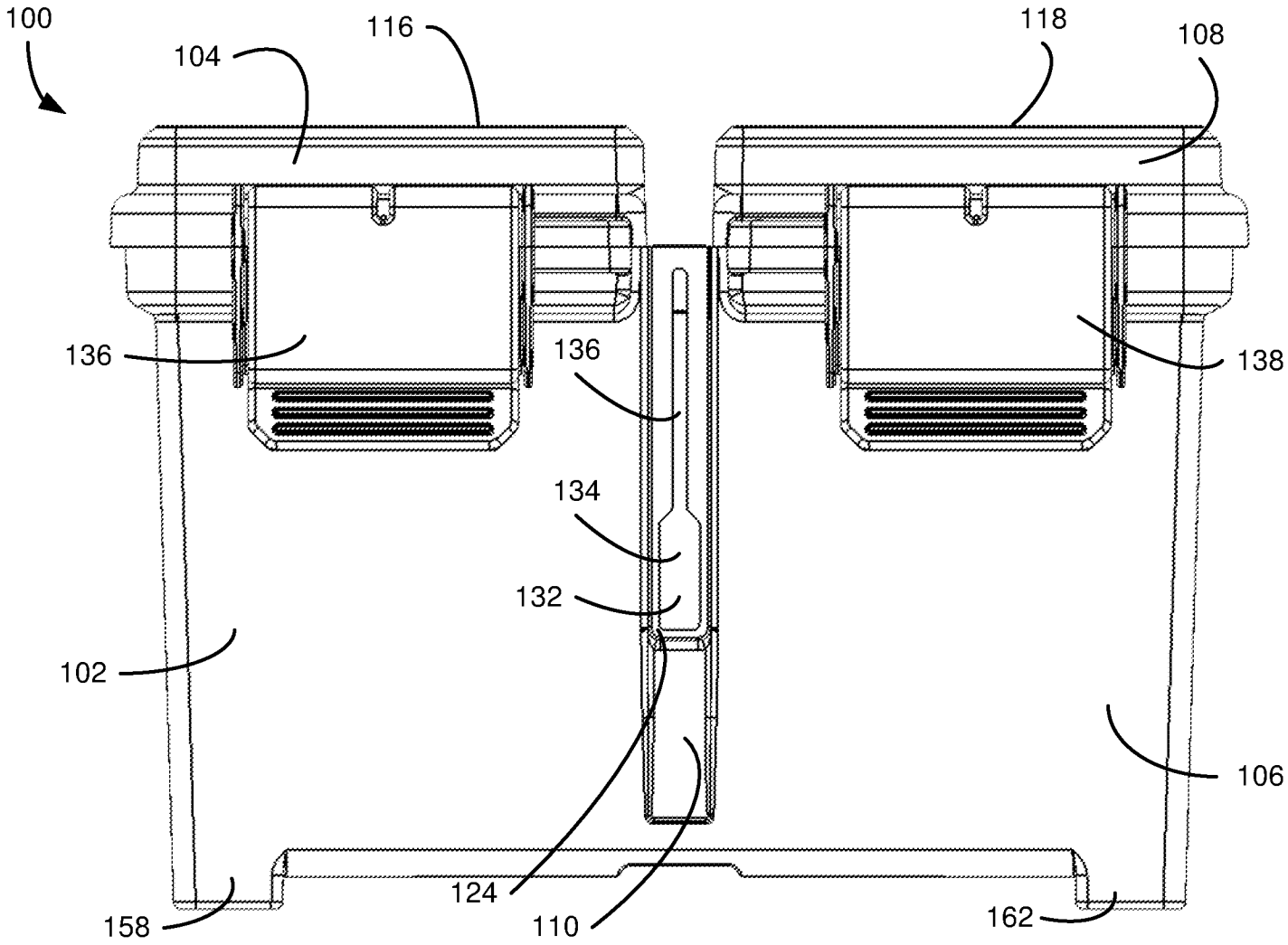
FIG. 4 is a front elevation view of the ammunition container of FIG. 1 with the handle removed.

FIG. 3, is an isometric view of the handle 112 shown in FIGS. 1 and 2 and FIG. 4 is a front view of the ammunition container 100 of FIGS. 1 and 2 with the handle 112 removed. Referring to FIG. 3, the handle 112 generally includes a top portion 113 and a pair of handle extensions 120, 122 extending therefrom. The handle extensions 120, 122 are shaped to be received by grooves, such as a first handle channel 124 (shown, for example, in FIG. 1) defined by the compartments 102, 106 and the divider 110. A second handle channel may be disposed opposite the first channel 124 and also defined by the compartments 102, 106 and the divider 110. Each of the handle extensions 120, 122 may include features adapted to couple the handle 112 to corresponding features of the divider 110. For example, the handle 112 includes t-shaped protrusions 128, 130 disposed on the inside of distal ends of the handle extensions 120, 122, respectively. As shown in FIG. 4, the divider 110 may include a first slot 132 and a second slot (not shown) disposed opposite the first slot 132 adapted to receive the coupling features of the handle 112. For example, the first slot 132 includes a wide section 134 into which a first t-shaped protrusion 128 may be inserted. The second t-shaped protrusion 130 may also be inserted into a corresponding wide section of the second slot. When the handle 112 is extended, the t-shaped protrusions 128, 130 may then engage narrow sections of the divider slots, such as the narrow section 136 of the first slot 132.

Referring back to FIGS. 1 and 2, the ammunition container 100 may include closures for retaining the lids 104, 108 in a closed configuration. For example, the ammunition container 100 includes hinged clasps 136, 138 coupled to each of the lids 104, 108 that may be rotated and pressed down to engage retention features of the compartments 102, 106. To open the lids 104, 108, the clasps 136, 138 may be pulled to disengage the retention features and rotate away from the compartments 102, 106. In other implementations of the present disclosure, other closure may be used to secure the lids 104, 108 in a closed position. For example, such closures may include, but are not limited to, one or more of twist lock closures, strap and buckle arrangements, clips, and draw bolt closures. In other implementations, the lids 104, 108 may also be retained by interference or press fits with an upper portion of the compartments 102, 106 such that no additional closure is required. In still other implementations, the lids 104, 108 may include a lip or groove extending around their circumference that mates with a corresponding groove or lip, respectively disposed on an upper portion of the compartments 102, 106.

The ammunition container 100 may also include features for locking the lids 104, 108 into the closed position relative to the compartments 102, 106. For example, the ammunition container 100 of FIGS. 1 and 2 includes lock tabs 140, 142 defining respectively lock holes 144, 146 through which a shackle or shank of a lock, such as a padlock or combination lock, may be inserted. In certain implementations, a lock mechanism may be incorporated directly into the ammunition container 100. For example, a key or combination lock may be integrated into the ammunition container 100 to lock the lids 104, 108 to their corresponding compartments 102, 106. Such locking mechanisms may be incorporated into or used instead of the closure mechanisms described above. For example, in implementations in which a draw bolt closure is used, the draw bolt closure may include an integrated key lock.

Figure 5:
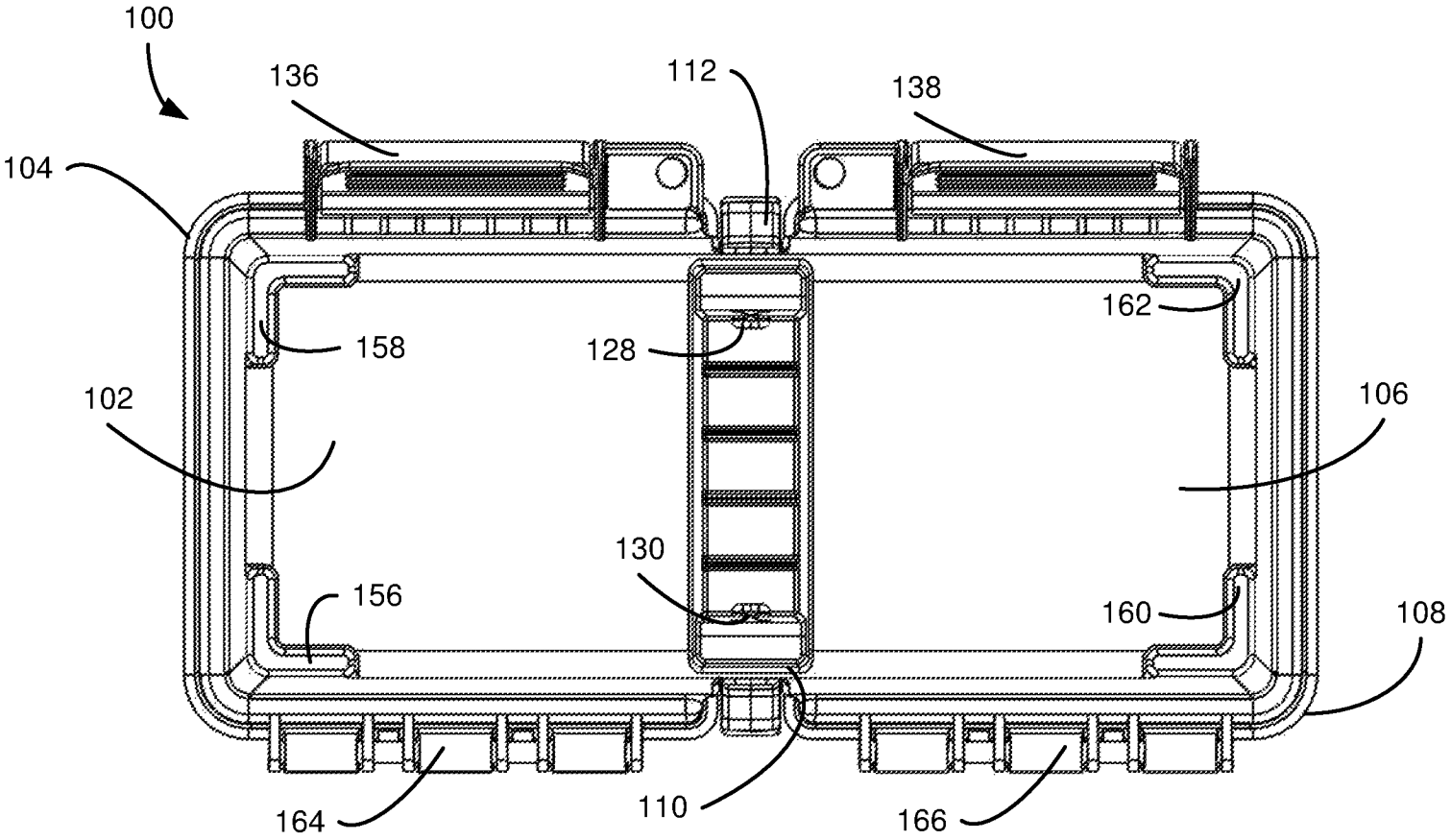
FIG. 5 is a bottom plan view of the ammunition container of FIG. 1.

The ammunition container 100 may further include features to facilitate stacking of the ammunition container 100 with similar containers for purposes of storage and transportation. For example, as shown in FIGS. 1 and 2, each of the lids 104, 108 include pairs of indentations 148-154. The indentations 148-154 are generally shaped to mate with corresponding feet 156-162 disposed at the bottom of the ammunition container 100 and which are most clearly shown in FIG. 5, which is a bottom plan view of the ammunition container 100. In certain implementations, the feet 156-162 and the indentations 148-154 are shaped such that an interference fit occurs when the feet 156-162 of the ammunition container 100 are inserted into the corresponding indentations of a second ammunition container or vice versa. In such implementations, a positive engagement is created between the feet and the indentations such that decoupling of the ammunition containers is resisted. Although four angled indentations and feet are included in the ammunition container 100, other shapes and quantities of indentations and feet may be used in a similar manner as described above.

In certain implementations, the compartments 102, 106 and/or the lids 104, 108 may include a gasket or similar sealing element such that a seal is formed between the compartments 102, 106 and their respective lids 104, 108 when the lids 104, 108 are closed. For example, in certain implementations, the lids 104, 108 may include a gasket extending around their perimeter such that a water-tight seal is formed between the lids 104, 108 and the compartments 102, 106 when the lids 104, 108 are closed and the clasps 136, 138 are engaged. Provided a suitable seal results, such gaskets may be formed of varying materials including, without limitation, rubber, and plastic.

Figure 6:
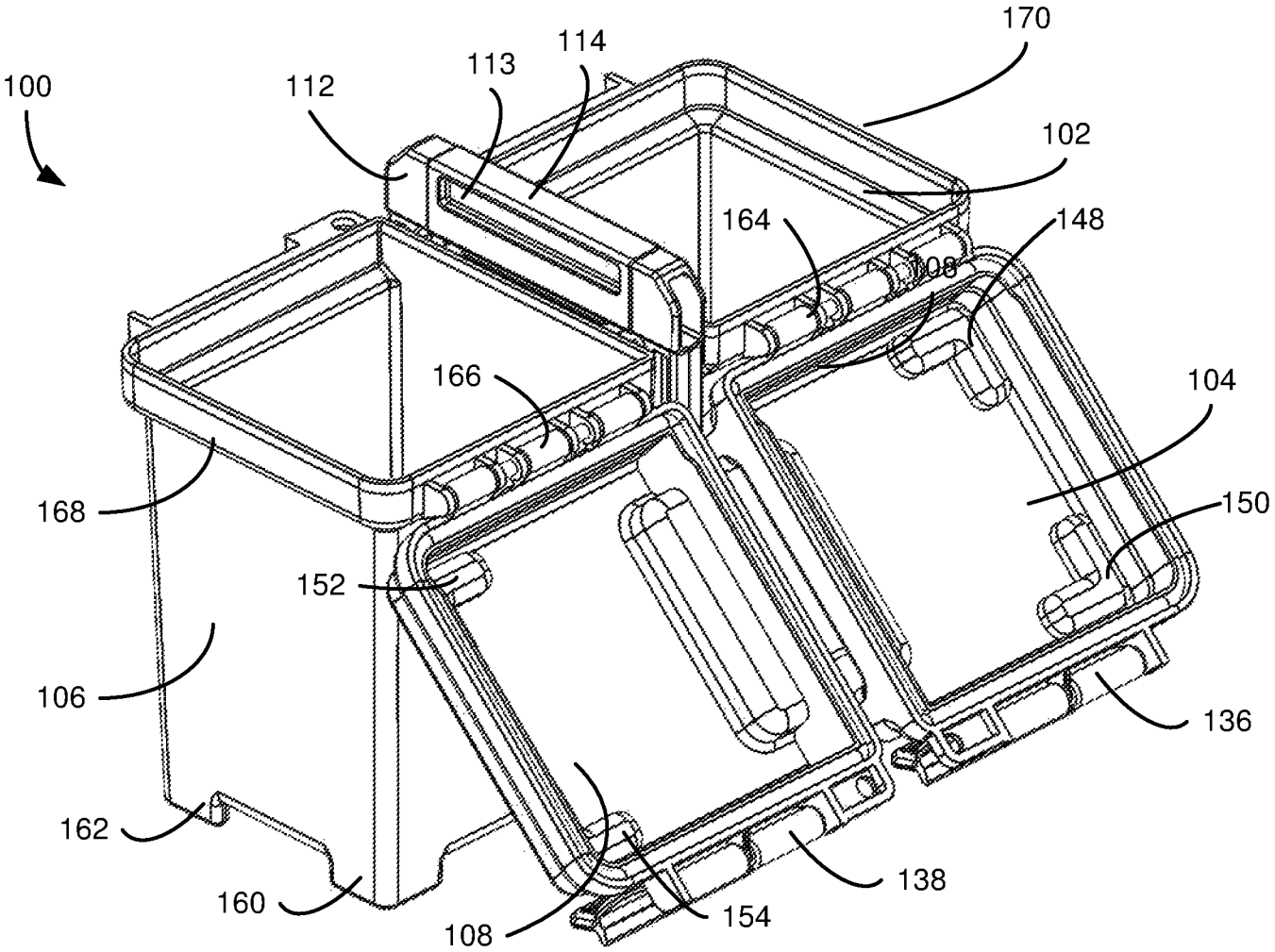
FIG. 6 is a rear isometric view of the ammunition container of FIG. 1 in an open configuration.

FIG. 6 is a rear isometric view of the ammunition container 100 shown in an open configuration. As shown, the lids 104, 108 are coupled to their corresponding compartments 102, 106 by respective hinges 164, 166. The hinges 164, 166 are shown as being integrally formed, at least in part, with the lids 104, 108 and the compartments 102, 106. In other implementations, the hinges 164, 166 may be separate but coupled to the lids 104, 108 and the compartments 102, 106. Moreover, while the hinges 164, 166 are shown as pin-type hinges, other hinge types, such as living hinges, may be used instead of pin-type hinges.

As shown in FIG. 6, the hinges 164, 166 are disposed opposite the clasps 136, 138. However, in other implementations, the hinges 164, 166 may disposed on adjacent sides of the compartments 102, 106. For example, in one implementation, the hinges may be disposed on the outer faces 168, 170 of the ammunition container such that each lid 104, 108 opens in an outward direction. Alternatively, the clasps 136, 138 or other closures may be disposed on the outer faces 168, 170.

Each compartment 102, 106 may include internal dividers (not shown) to further subdivide the internal volume of the compartments 102, 106. Such dividers may, for example, divide the internal volume of the compartments 102, 106 into separate horizontal layers, vertical columns, or a combination of horizontal layers and vertical columns. Internal dividers may be permanently disposed within the compartments 102, 106, such as by integrally forming the dividers with the compartments 102, 106. Alternatively, the internal dividers may be removable from within the compartments 102, 106 such that the arrangement of subdivisions within the compartments 102, 106 may be changed according to the needs of a user. In certain implementations, the internal surface of the compartments 102, 106 may include grooves, lips, channels, or similar features shaped to receive the dividers.

Although the ammunition container 100 is illustrated as including only two compartments 102, 106, other implementations of the present disclosure may include any suitable number of compartments. For example, in one implementation, additional compartments may be disposed adjacent each of the compartments 102, 106 such that the resulting ammunition container includes four collinear compartments. In another implementation, the additional compartments may be disposed adjacent to each other such that the compartments are in parallel (e.g., the compartments may be arranged along the divider). In implementations including more than two compartments, each compartment may include independent lids or, alternatively, subsets of the compartments may share a lid. For example, each compartment disposed on a first side of the handle 112 may share a first lid while each compartment disposed on a second side of the handle 112 may share a second lid. The lids of adjacent compartments may be configured to open in the same direction or in opposite directions. For example, in an implementation in which all compartments are in a collinear arrangement, adjacent compartments (or adjacent subsets of compartments sharing lids) may be configured such that their respective lids open in alternating directions. Similarly, in implementations in which compartments are arrange in parallel, lids of adjacent compartments may be configured to open in opposite directions (e.g., towards each other).

Figure 7:
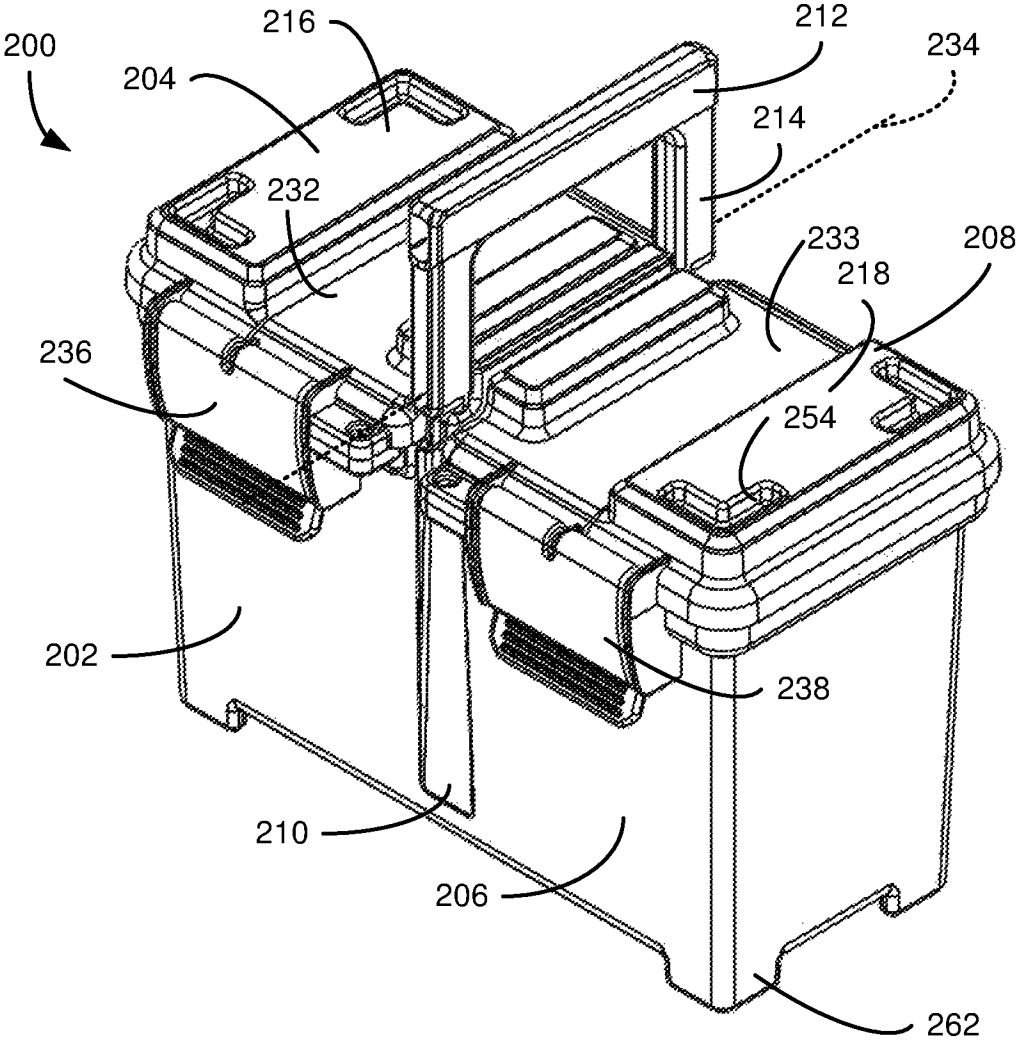
FIG. 7 is an isometric view of a second ammunition container with a handle in an upright position.
Figure 8:
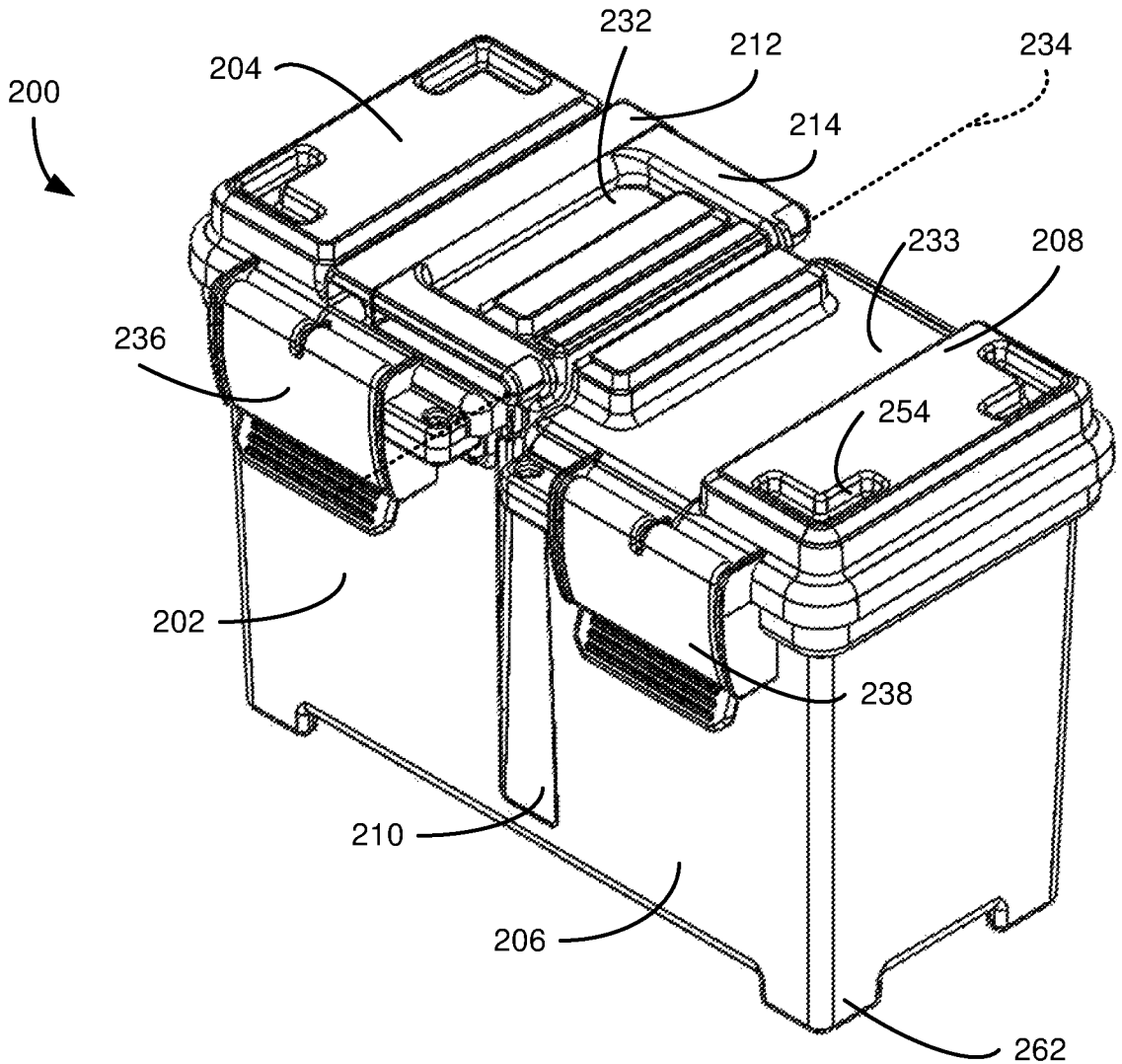
FIG. 8 is an isometric view of the ammunition container of FIG. 7 with the handle in a downed position.

FIGS. 7 and 8 are isometric views of a second ammunition container 200 according to the present disclosure. The ammunition container 200 includes two adjacent compartments 202, 206, each having respective lids 204, 208. The lids 204, 208 are coupled to their respective compartments 202, 206 such that each lid 204, 208 may be opened and closed independently.

The compartments 202, 206 are adjoined by a divider 210 to which a handle 212 is coupled. The handle 212 is coupled to the divider 210 such that the handle 212 is permitted to rotate or swivel about an axis of rotation 234 extending through an upper portion of the divider 210. More specifically, the handle 212 is permitted to rotate between an upright position, as shown in FIG. 7, and a downed position, as shown in FIG. 8 in which the handle 212 is folded down into a channel 232 or similar recess of the lid 204, the channel 232 being shaped to receive the handle 212 such that the handle 212 lies substantially flat. In the implementation illustrated in FIGS. 7 and 8, the handle 212 may also be folded into a second downed position by folding the handle 212 into a similar channel 233 of the lid 208. When the handle 212 is in the downed position, a side surface 214 of the handle 212 is flush with or below top surfaces 216, 218 of the lids 204, 208. Accordingly, other items, including other ammunition containers in accordance with this disclosure, may be readily stacked on top of the ammunition container 200.

Similar to the ammunition container 100 illustrated in FIGS. 1 and 2, the ammunition container 200 includes clasps 236, 238 for coupling the lids 204, 208 to their respective compartments 202, 206. The ammunition container 200 also includes feet, such as the foot 262, and corresponding indentations, such as indentation 254, to facilitate stacking of the ammunition container 200 with similar ammunition containers for purposes of transportation and storage. Other features and variations described above in the context of the ammunition container 100 of FIGS. 1 and 2 may also be incorporated into the ammunition container including a swiveling handle, such as included in the ammunition container 200.

Ammunition containers in accordance with the present disclosure may include features that facilitate stacking of the ammunition containers. In general, such features include indentations or recesses disposed on a top surface of the ammunition container and corresponding feet extending from a bottom surface of the ammunition container. To stack the ammunition containers, the feet of a first or upper ammunition container may be received within the recesses of a second or lower ammunition container.

During stacking, retention and coupling of the feet of the upper ammunition container within the recesses of the lower container may be varied by adjusting the relative fit between the feet of the upper ammunition container and the recesses of the lower ammunition container. In general, a tighter fit results in increased retention and coupling between the two ammunition containers resulting in greater overall stability when stacked while a looser fit enables easier disassembly of stacked ammunition containers.

A balance between retention and stability of the ammunition containers when stacked and ease of disassembly may be achieved by a corresponding balanced fit between the feet and recesses. For example, if the fit between the feet and recesses is too loose, stacked ammunition containers may be prone to toppling. However, if the fit between the feet and recesses is too tight, decoupling stacked ammunition containers may be difficult. Such rigid coupling may be particularly problematic in applications where the ammunition containers are filled or otherwise made heavy with ammunition or other items. Accordingly, certain aspects of the present disclosure relate to recess and feet designs that have been found, through testing, to provide a particularly balanced retention between stacked ammunition containers.

In another aspect of the present disclosure, the feet and recesses may be shaped and arranged to provide particularly high stability when the ammunition containers are stacked such that the stacked ammunition containers are better able to resist movement or otherwise withstand forces applied to the stacked ammunition containers. In at least certain implementations, ammunition containers in accordance with the present disclosure may include recesses and feet that extend along each of perpendicular axes corresponding to the width and depth of the ammunition container. Accordingly, the recesses and feet provide improved stability and resist toppling when forces are applied along either or both axes. For example, in one particular implementation, the recesses and feet may have an "L" or similar shape with each segment of the "L" shape extending along a respective one of the width or depth of the ammunition container.

The foregoing advantages and concepts, among others, are now discussed with reference to the figures.

Figure 9:
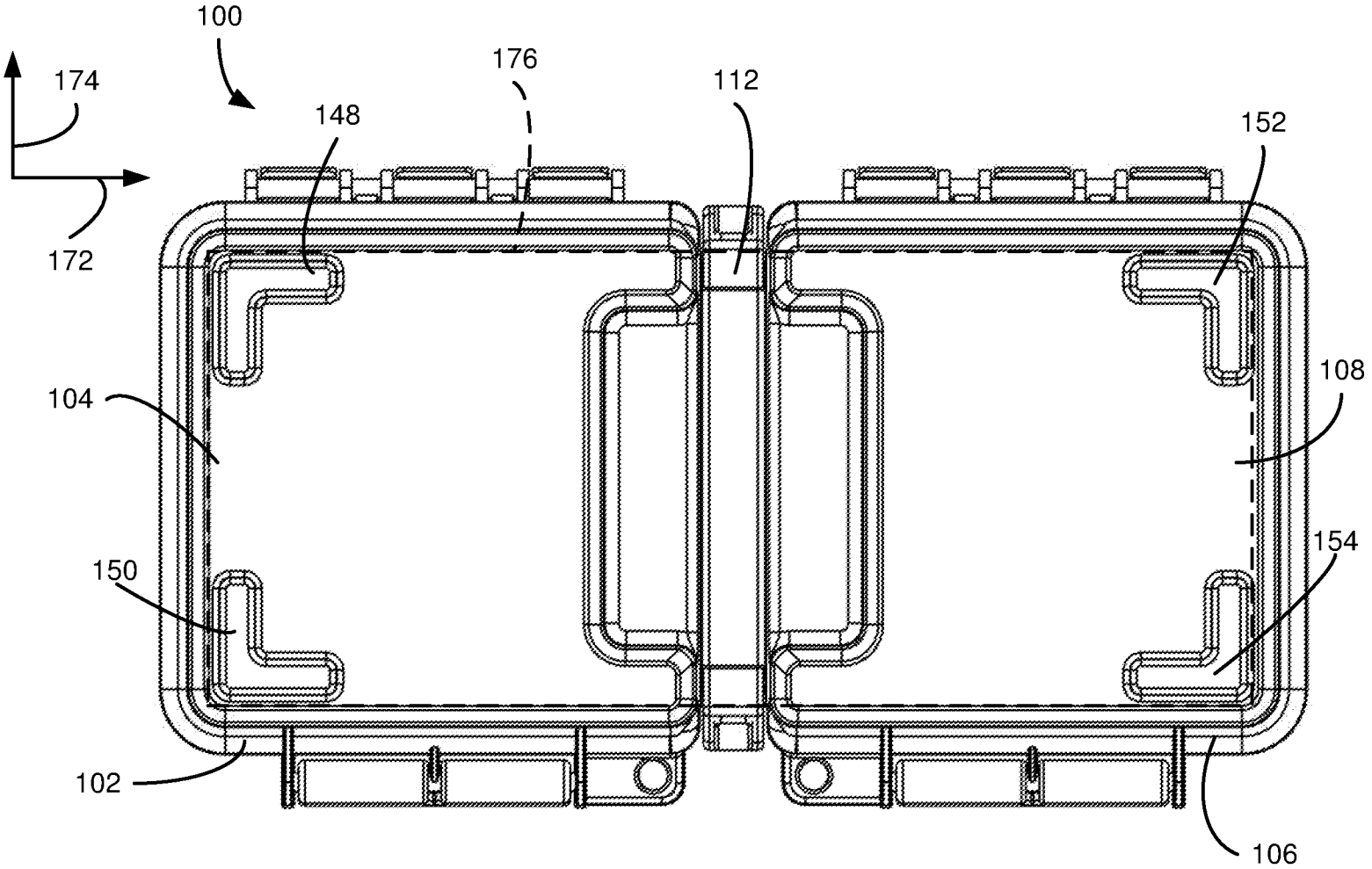
FIG. 9 is a top plan view of the ammunition container of FIG. 1.

FIG. 9 is a top view of the ammunition container 100 of FIG. 1. The following discussion further references elements on the bottom of the ammunition container 100, which is most clearly visible in FIG. 5. As illustrated in FIG. 9, the ammunition container 100 may have an overall rectangular shape, from the top view perspective (or bottom view perspective) although implementations of the present disclosure are not necessarily limited to rectangular ammunition containers. For purposes of the present disclosure, the rectangular shape is generally referred to as having a width extending along a first axis 172 and a depth extending along a second axis 174 perpendicular to the first axis 172, as indicated in FIG. 9.

As previously discussed in the context of FIGS. 1 and 2, the ammunition container 100 may include multiple compartment portions, with one example including a including a compartment 102, 106 with a respective lid 104, 108. When closed, the lids 104, 108 collectively define a top surface 176 (shown in dashed lines), below which a handle 112 is disposed when the handle 112 is in a retracted configuration.

Each of the lids 104, 108 may include one or more indentations or recesses 148-154 extending into the lid 104, 108 from the top surface 176 and shaped to correspond to the feet 156-162 (shown in FIG. 5) of the ammunition container 100. As shown in FIGS. 1-6, the feet 156-162 generally extend from a bottom of the ammunition container 100 defined by bottom surfaces of the compartments 102, 106. For example, the lid 104 includes recesses 148 and 150 which generally correspond to feet 156 and 158, respectively, and which extend from the bottom of compartment 102. Similarly, the lid 108 includes recesses 152 and 154, which correspond to feet 160 and 162, respectively, and which extend from the bottom of compartment 106.

In the specific example of the ammunition container 100, each of the recesses 148-154 and the feet 156-162 have are "L"-shaped. More specifically and as discussed below in further detail in the context of FIGS. 10 and 11, each of the recesses 148-154 includes a first segment 155A (shown in FIG. 10) extending along the width of the ammunition container 100 and a second segment 155B (also shown in FIG. 10) in communication with the first segment 155A and extending along the depth of the ammunition container 100. Similarly, each of the feet 148-154 includes a first segment

163A (shown in FIG. 11) extending along the first axis 172 of the ammunition container 100 and a second segment 163B (also shown in FIG. 11) connected to the first segment 163A and extending along the second axis 174 of the ammunition container 100. Also in the specific example of the ammunition container 100, the recesses 148, 150 and the recesses 152, 154 are positioned in the exterior corners of the top surface 176 of the lids 104, 108, respectively. Similarly (and as most clearly illustrated in FIG. 5), the feet 156, 158 and the feet 160, 162 are positioned in exterior corners on the underside of the compartments 102, 106, respectively.

Although illustrated in the figures as being substantially rectangular or including connected rectangular segments, the feet and recesses of ammunition containers in accordance with the present disclosure are not limited to any particular shape or size. For example, in addition to or instead of rectangular-shaped feet and recesses, ammunition containers in accordance with the present disclosure may include corresponding circular, ovate, square, triangular, or any other similar shape. In one specific example, the recesses may be tapered circular indentations defined within the lids of the ammunition container compartments and the feet may be corresponding conical or frustroconical protrusions. Accordingly, unless otherwise specified, the feet and recesses of the present disclosure are not limited to any particular size or shape.

In at least certain implementations, such as the ammunition container 100, the recesses 148-154 may be disposed in the outer corners of the top surface 176 of the ammunition container 100 but fully within the outer extents of the top surface 176. In other words, the recesses 148-154 are fully defined and enclosed by their respective lids such that the recesses 148-154 do not extend to or otherwise open to the outer extent of the top surface 176. Such arrangements facilitate improved retention and stability of stacked ammunition containers by ensuring that the feet 156-162 of an upper container are fully retained within the recesses 148-154 of a lower container and fully surrounded by the sidewalls of the recesses 148-154, thereby limiting movement of the upper ammunition container.

The L-shaped recesses 148-154 and L-shaped feet 156-162 of the ammunition container 100 are generally symmetrical in shape and position about the top and bottom of the ammunition container 100, respectively. As a result, a first of the ammunition container 100 may be stacked on a second of the ammunition container 100 in the same orientation or in orientations that are rotated 180 degrees relative to each other (e.g., with the clasps 136, 138 of the stacked ammunition containers facing opposite directions). However, in other implementations, the recesses and feet may be arranged and shaped such that only one orientation of stacked ammunition containers is permitted. For example, in certain implementations, the recesses and feet may be asymmetrically arranged, may have non-uniform sizes, or non-uniform shapes such that the ammunition container may only be stacked in a single orientation.

Figure 11:
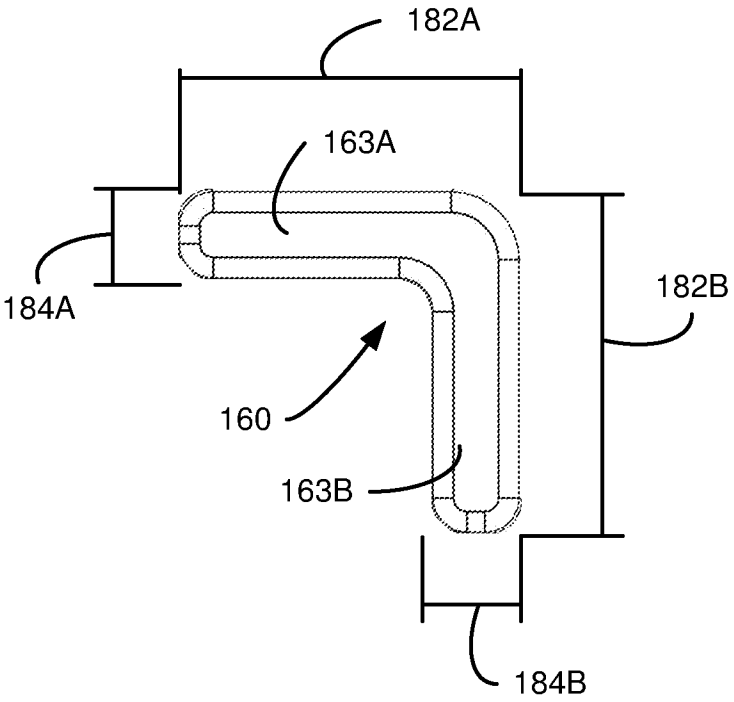
FIG. 11 is a detailed view of a foot of the ammunition container of FIG. 1 corresponding to the recess of FIG. 10.
Figure 10:
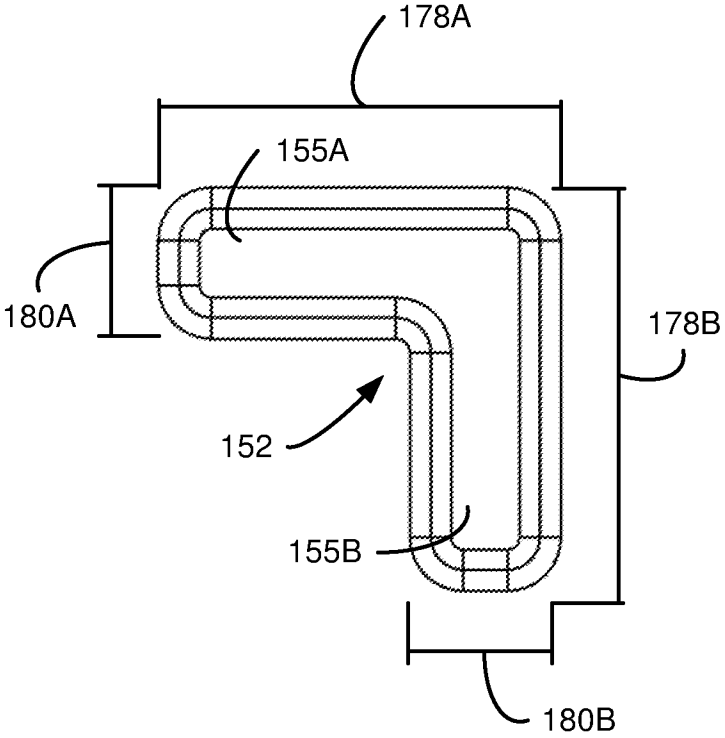
FIG. 10 is a detailed view of a recess of the ammunition container of FIG. 1.

Further details regarding the recesses 148-154 and the feet 156-162 are now provided with reference to FIGS. 10 and 11. In particular, FIG. 10 is a top detailed view of recess 152 of the ammunition container 100 and FIG. 11 is a detailed view of foot 160 of the ammunition container 100, which corresponds to recess 152 when two ammunition containers consistent with the ammunition container 100 are stacked in the same orientation. More specifically, FIG. 11 is a bottom detailed view of the foot 160 rotated to coincide with the view of the recess 152 provided in FIG. 11.

For purposes of the present disclosure, a recess and a foot are said to "correspond" if the foot of a first ammunition container is designed to be inserted into the recess of a second ammunition container during stacking of the ammunition containers. In certain designs according to the present disclosure, a recess may correspond to multiple feet and/or a foot may correspond to multiple recesses. For example and as discussed above, in certain implementations, the feet and recesses of a pair of ammunition containers may be configured such that the ammunition containers may be stacked with both ammunition containers facing the same direction or facing opposite directions. So, for example, recess 152 of a first ammunition container may correspond to foot 160 of a second ammunition container when the ammunition containers are stacked in the same orientation or may correspond to foot 158 when the ammunition containers are stacked in oppositely facing orientations. Similarly, while foot 160 of the second container corresponds to recess 152 of the first ammunition container when the stacked ammunition containers are oriented in the same direction, foot 160 of the second container would correspond to recess 150 of the second ammunition container when stacked in alternating orientations.

Corresponding feet and recesses of ammunition containers in accordance with the present disclosure may have particular dimensions or dimensional relationships specifically selected to facilitate stability during stacking while maintaining relative ease of unstacking. For example, each recess may generally be defined by a recess length and a recess width and each foot may be similarly defined by a foot width and a foot length. For purposes of the present disclosure, the term "length" in the context of feet or recesses generally refers to a first dimension of the foot or the recess and width generally refers to a second dimension perpendicular to the first dimension, where the length is greater than or equal to the width.

Figure 20:
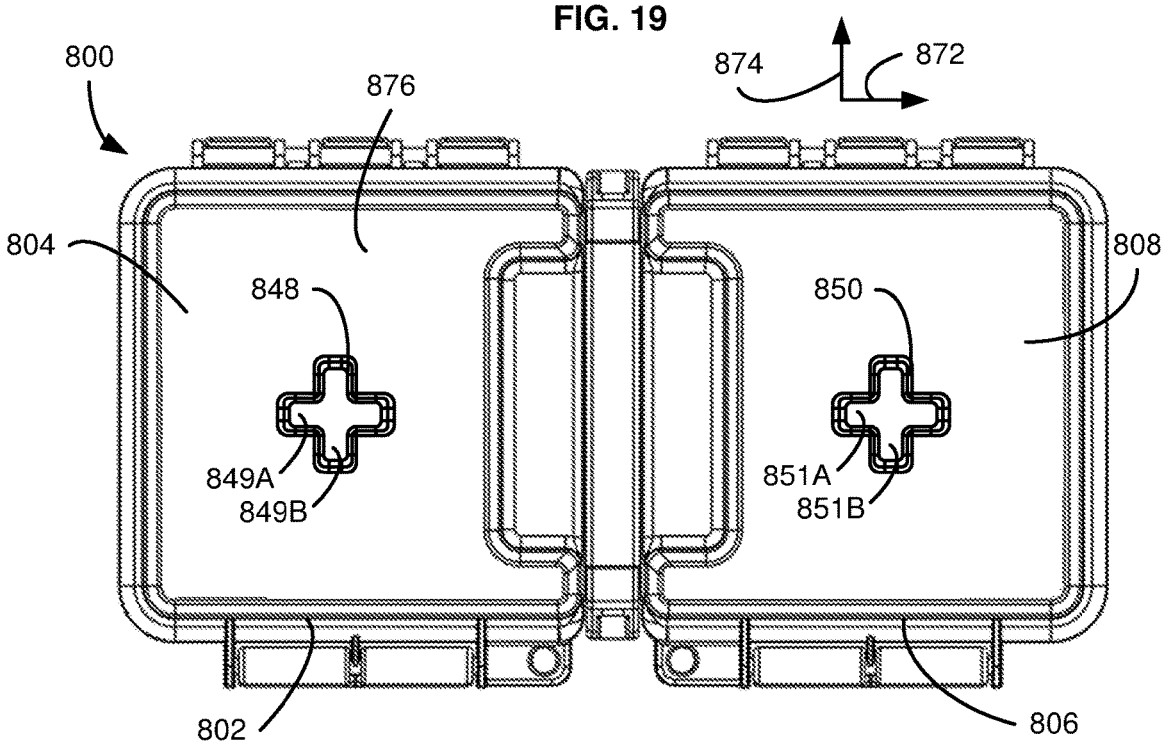
FIG. 20 is a top plan view of another ammunition container, the ammunition container having multi-segment "plus"-shaped recesses.

In implementations in which the recesses and feet include multiple segments, such as the L-shaped recesses and feet of the ammunition container 100 (or the "plus"-shaped recesses and feet of the ammunition container 800 illustrated in FIG. 20), the "length" and "width" generally refer to the length or width of one segment of the recesses or feet. So, for example, referring to FIG. 10, the recess 152 includes a first segment 155A and a second segment 155B perpendicular to the first segment 155A. The first segment 155A has a first segment length 178A and a first segment width 180A while the second segment 155B has a second segment length 1788 and a second segment width 1808. The lengths and widths of the recess segments may be but do not necessarily have to be equal. Similarly, the foot 160 includes a first foot segment 163A and a second foot segment 163B perpendicular to the first foot segment 163A. The first foot segment 163A has a first foot length 182A and a first foot width 184A while the second foot segment 163B has a second foot length 182B and a second foot width 184B. Again, the lengths and widths of the foot segments may be but do not necessarily have to be equal.

In certain implementations, a recess length (whether of a single recess or a segment of a multi-part recess) may be defined relative to its corresponding foot length. For example, in certain implementations and without limitation, the recess length may be from and including about 5 percent to and including about 15 percent longer than the corresponding foot length. Similarly, in certain implementations and without limitation, the recess width may be from and including about 5 percent to and including about 15 percent wider than the corresponding foot width.

In still other implementations, dimensions of the recesses and feet may be based on absolute differences. For example, in certain implementations and without limitation, the recess length may be from and including about 0.05 inches to and including about 0.15 inches greater than the foot length. Similarly, in certain implementations and without limitation, the recess width may be from and including about 0.05 inches to and including about 0.1 inches wider than the foot width.

Although ammunition containers according to the present disclosure are not limited to any specific dimensions, in at least certain implementations, the recess length may be from and including about 0.75 inches to and including about 1.25 inches and the recess width may be from and including about 0.25 inches to and including about 0.35 inches. In such implementations, the foot length may be from and including about 0.7 inches to and including about 1.2 inches but less than the recess length and the foot width may be from and including about 0.2 inches to and including about 0.3 inches but less than the recess width. In one specific implementation, the recess length may be about 1.085 inches and the recess width 180 may be about 0.33 inches. In such implementations, the foot length may be about 1.00 inches and the foot width may be about 0.25 inches.

Figure 12:
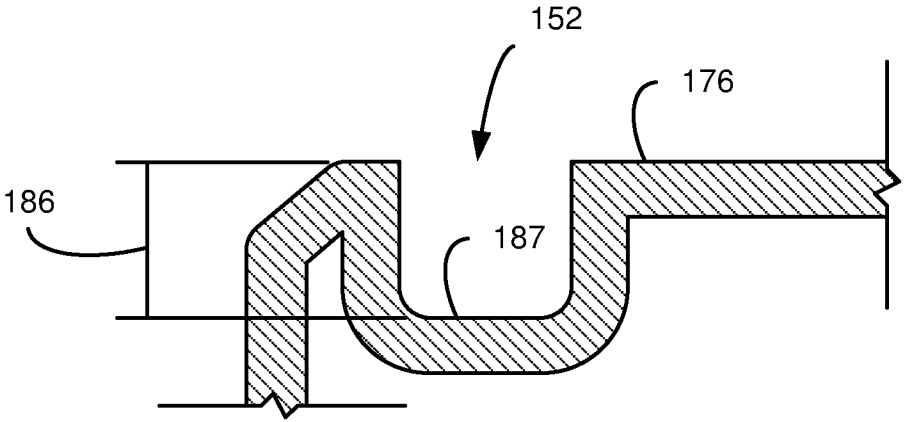
FIG. 12 is a cross-sectional view of the recess of FIG. 10.
Figure 13:
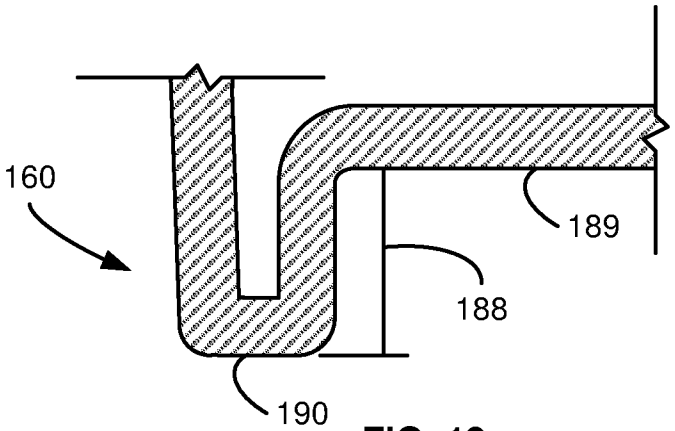
FIG. 13 is a cross-sectional view of the foot of FIG. 11.
Figure 14:
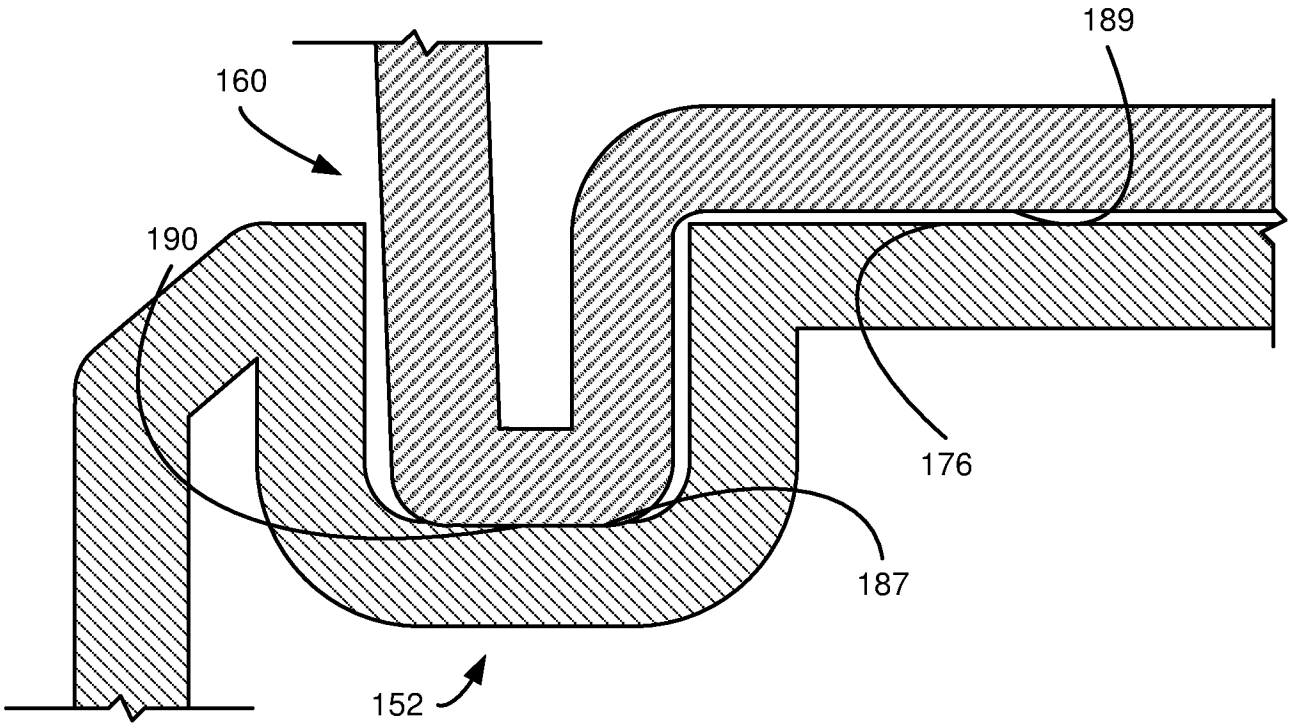
FIG. 14 is a cross-sectional view of the foot of FIG. 11 received within the recess of FIG. 10.

In addition to their lengths and widths, each of the feet and recesses may be further defined by a height extending perpendicular to the length and width. For example, as illustrated in FIG. 12, which is a cross-sectional view of the recess 152, the recess 152 may have a recess depth 186 defined as the distance from the top surface 176 of the ammunition container 100 to a bottom 187 of the recess 152. Similarly FIG. 13 is a cross-sectional view of the foot 160, which generally corresponds to the recess 152. As indicated in FIG. 13, the foot 160 may have a foot depth 188 which generally corresponds to a distance between a bottom surface 189 of the ammunition container 100 and a bottom 190 of the foot 160. FIG. 14 is a cross-sectional view of the foot 160 received within the recess 152. Although the specific depths of recesses and feet may vary, the foot depth 188 is generally equal to or greater than the recess depth 186. For example and without limitation, in at least one implementation, each of the recess depth 186 and the foot depth 188 may be approximately 0.30 inches.

It should be understood that the foregoing description of recesses and feet with reference to the ammunition container 100 may be readily adaptable to other ammunition containers. For example, while the foregoing details regarding recesses and feet were generally discussed in the context of ammunition container 100, which includes a vertically telescoping handle 112, the foregoing description of recesses and feet are similarly applicable to the ammunition container 200 of FIGS. 7 and 8, which includes a rotating handle 212.

Implementations of the present disclosure are also not limited to the L-shaped recesses illustrated in the previously discussed figures. More generally, ammunition containers in accordance with the present disclosure may include any number, size, placement, or configuration of recesses and feet provided that the recesses and feet of the ammunition container correspond to facilitate vertical stacking of the ammunition container.

Examples of additional designs are provided in FIGS. 15-20 and are now discussed in further detail. Notably, each of FIGS. 15-20 is top views of different ammunition containers showing their respective recess configurations. Although not illustrated, it should be understood that each of the ammunition containers in FIGS. 15-20 also include feet corresponding to the recesses. More specifically, each of the ammunition containers includes feet extending from a bottom or underside thereof that correspond to the illustrated recesses.

Each of the ammunition containers in FIGS. 15-20 include example arrangements of recesses adapted to provide increased stability during stacking of the ammunition containers. As illustrated in the examples, such improved stability may be provided in part by, among other things and without limitation, one or more of including recesses and feet that extend along each of a width and depth of the ammunition container; including multiple recesses and feed extending along either of the width or the depth of the ammunition container; positioning recesses and feet in corners of the ammunition container; grouping recesses and feet together; including recesses and feet having segments extending along each of the width and depth of the ammunition container; or other similar techniques. Although the recesses and feet discussed in the following examples may be of any suitable shape and size, in at least certain implementations, the recesses and feet may conform to one or more of the various dimensional relationships discussed above in the context of the ammunition container 100.

Figure 15:
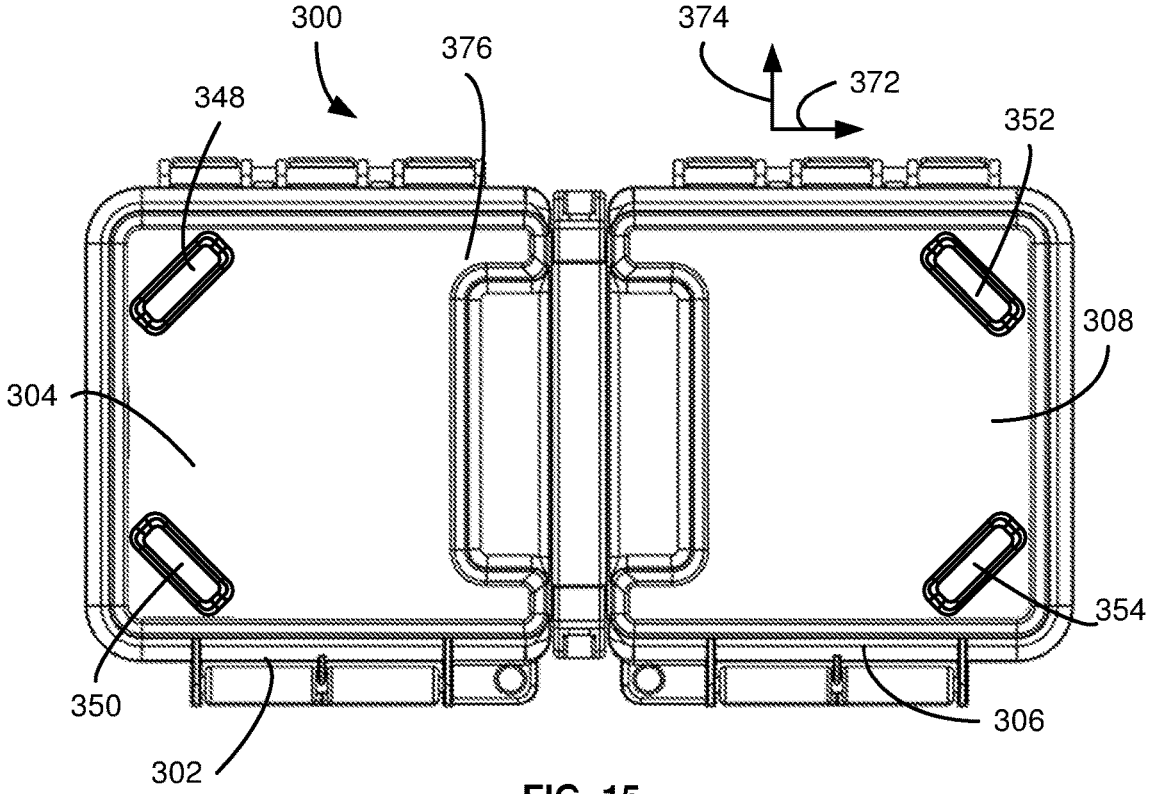
FIG. 15 is a top plan view of an alternative ammunition container, the ammunition container having obliquely oriented recesses.

Referring first to FIG. 15, a top view of an ammunition container 300 is provided. The ammunition container 300 includes multiple compartment portions, with each compartment portion including a compartment 302, 306 with a respective lid 304, 308. When closed, the lids 304, 308 collectively define a top surface 376 of the ammunition container 300. The top surface 376 is substantially rectangular and generally extends along a first axis 372 corresponding to a width of the ammunition container 300 and a second axis 374 corresponding to a depth of the ammunition container 300.

The ammunition container 300 includes four recesses 348-354, each of which is disposed in a respective corner of the top surface 376 and within an outer extent of the top surface 376. In contrast to the L-shaped recesses 148-154 of the ammunition container 100, which included a first segment extending along the width of the ammunition container 100 and a second segment extending along the depth of the ammunition container 100, the recesses 348-354 consist of a single segment extending in an oblique direction and, as a result, along each of the depth and width of the ammunition container 300. Accordingly, the recesses 348-354 similarly provide stability and restrict movement in the direction of each of the first axis 372 and the second axis 374.

Figure 16:
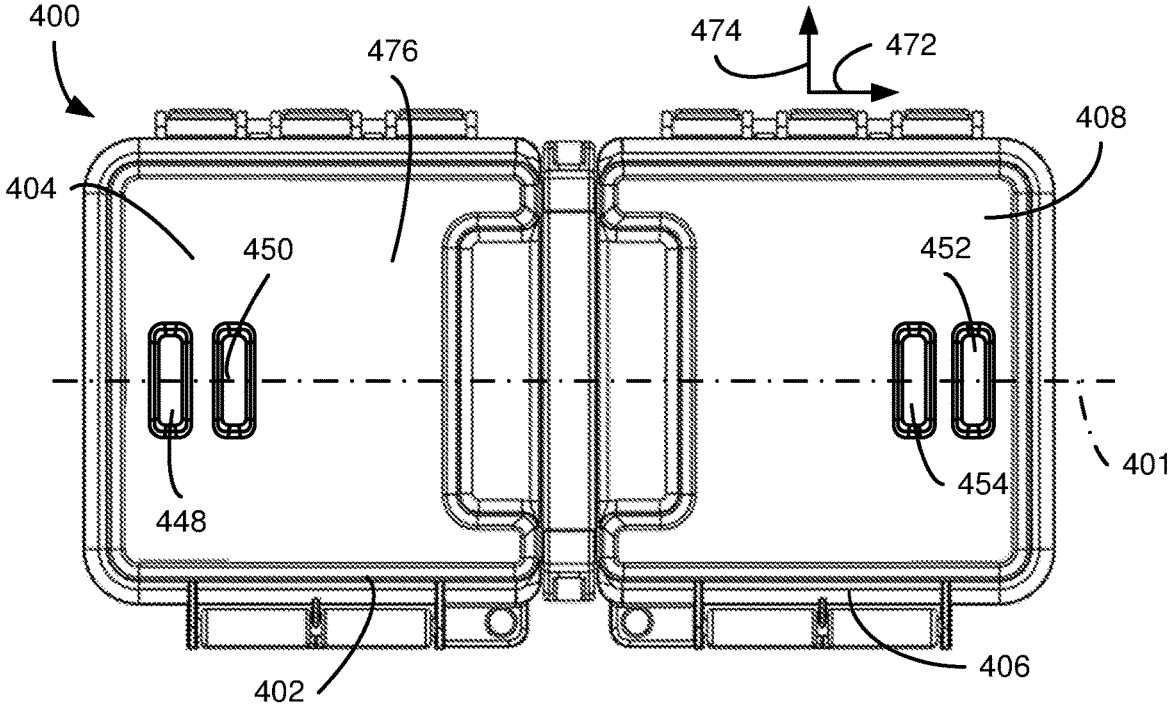
FIG. 16 is a top plan view of another alternative ammunition container, the ammunition container having groups of parallel recesses.

Referring next first to FIG. 16, a top view of an ammunition container 400 is provided. The ammunition container 400 includes multiple compartment portions, with each compartment portion including a compartment 402, 406 with a respective lid 404, 408. When closed, the lids 404, 408 collectively define a top surface 476 of the ammunition container 400. The top surface 476 is substantially rectangular and generally extends along a first axis 472 corresponding to a width of the ammunition container 400 and a second axis 474 corresponding to a depth of the ammunition container 400.

The ammunition container 400 includes four recesses 448-454, each of which is disposed along a mid-line 401 of the ammunition container 400. In contrast to the previously discussed implementations, which include a recess or recess segments extending along each of the width and depth of the corresponding ammunition container, the recesses 448-454 of the ammunition container 400 each extends along the second axis 474 (the depth) of the ammunition container 400 only. Nevertheless, stacking stability is provided by maintaining the recesses in pairs or similar groupings wherein each recess is maintained within relatively close proximity along the first axis 472 (e.g., the width) of the ammunition container 400. For example, the recess 448 and the recess 450 are maintained in one such pair while the recess 452 and the recess 454 are maintained in a second such pair. Moreover, while the widths of the recesses 448-454 are illustrated as being substantially less than their respective lengths, the collective width of all of the recesses 448-454 provides further stability during stacking.

Figure 17:
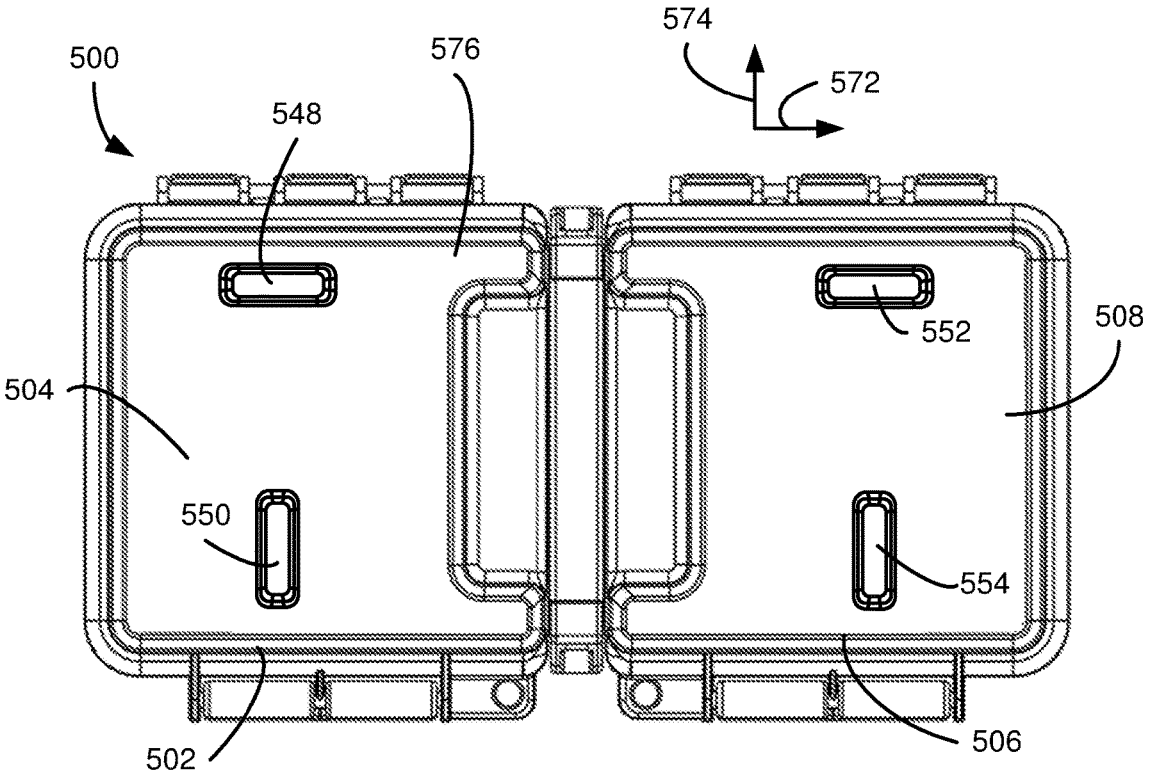
FIG. 17 is a top plan view of yet another ammunition container, the ammunition container having perpendicularly aligned recesses.

Referring next first to FIG. 17, a top view of an ammunition container 500 is provided. The ammunition container 500 includes multiple compartment portions, with each compartment portion including a compartment 502, 506 with a respective lid 504, 508. When closed, the lids 504, 508 collectively define a top surface 576 of the ammunition container 500. The top surface 576 is substantially rectangular and generally extends along a first axis 572 corresponding to a width of the ammunition container 500 and a second axis 574 corresponding to a depth of the ammunition container 500.

In the example of FIG. 17, stability during stacking is provided by including recesses that extend along each of the first axis 572 and the second axis 574. For example, the ammunition container 500 includes four recesses 548-554. The lid 504 defines a recess 548 extending along the first axis 572 and a recess 550 extending along the second axis 574. Similarly, the second lid 508 defines a recess 552 extending along the first axis 572 and a recess 554 extending along the second axis 574. Accordingly, each of the first lid 504 and the second lid 508 define recesses extending along and providing stability and support along each of the first axis 572 and the second axis 574. More specifically, the recesses 548 and 552, which extend along the first axis 572 generally provide increased stability and resist movement in the direction of the second axis 574 while the recesses 550 and 554, which extend along the second axis 574 generally provide increased stability and resist movement in the direction of the second axis 572.

Figure 18:
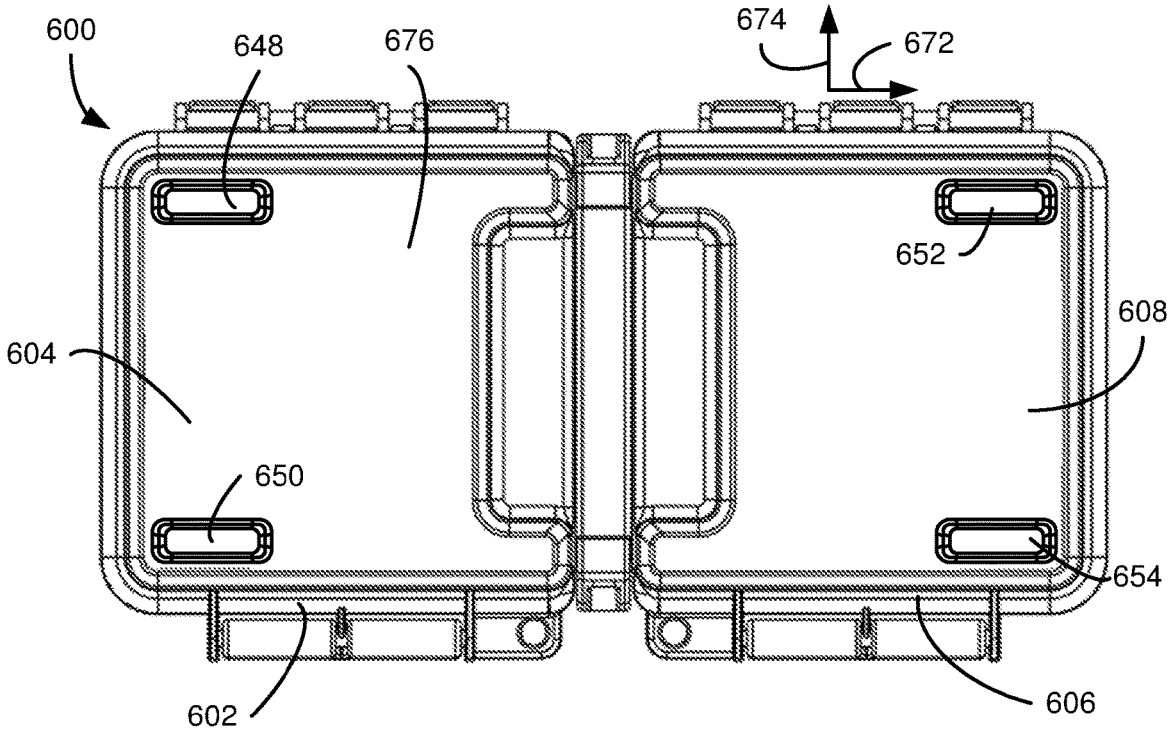
FIG. 18 is a top plan view of another ammunition container, the ammunition container having parallel recesses disposed at corners of a top surface.

Referring next first to FIG. 18, a top view of an ammunition container 600 is provided. The ammunition container 600 includes multiple compartment portions, with each compartment portion including a compartment 602, 606 with a respective lid 604, 608. When closed, the lids 604, 608 collectively define a top surface 676 of the ammunition container 600. The top surface 676 is substantially rectangular and generally extends along a first axis 672 corresponding to a width of the ammunition container 600 and a second axis 674 corresponding to a depth of the ammunition container 600.

In the example of FIG. 18, stability during stacking is provided by including multiple recesses that extend along the first axis 672 but that are distributed across the top surface 676. For example, the ammunition container 600 includes four recesses 648-654. The lid 604 defines recesses 648, 650 that extend along the first axis 672 and are positioned in corners of the top surface 676 defined by the lid 604. Similarly, the second lid 608 defines recesses 652, 654, which also extend along the first axis 672 and which are also positioned in corners of the top surface 676 defined by the lid 608.

Figure 19:
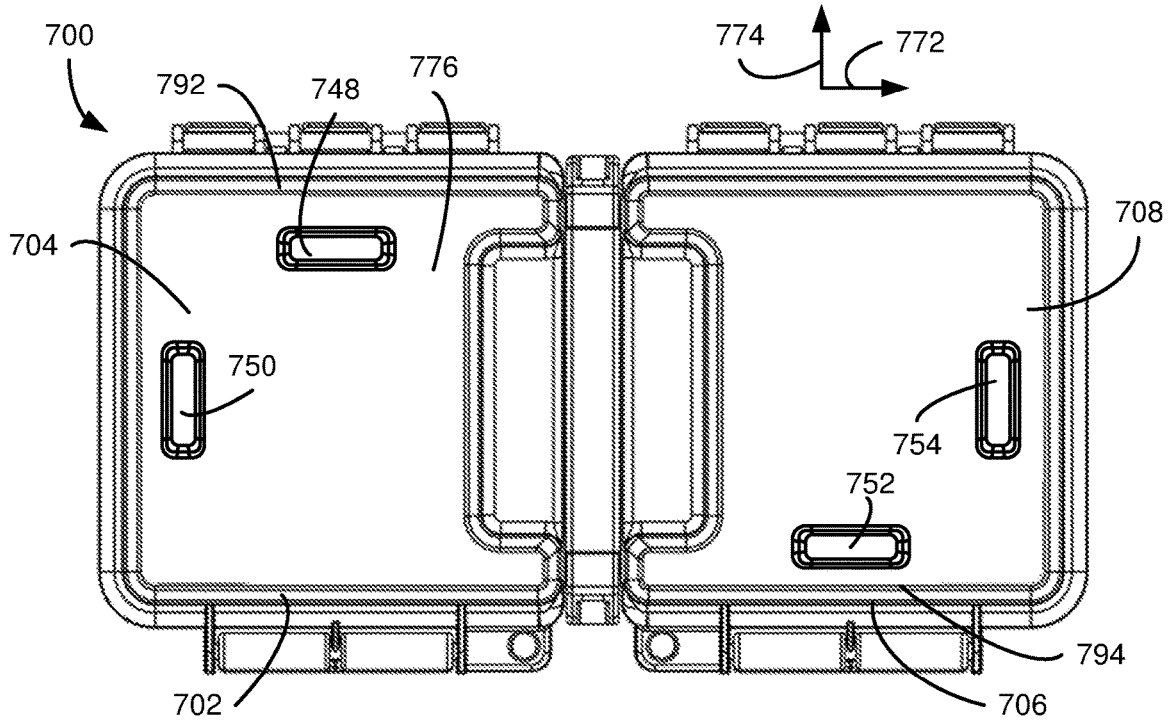
FIG. 19 is a top plan view of still another ammunition container, the ammunition container having perpendicularly aligned recesses.

Referring next first to FIG. 19, a top view of an ammunition container 700 is provided. The ammunition container 700 includes multiple compartment portions, with each compartment portion including a compartment 702, 706 with a respective lid 704, 708. When closed, the lids 704, 708 collectively define a top surface 776 of the ammunition container 700. The top surface 776 is substantially rectangular and generally extends along a first axis 772 corresponding to a width of the ammunition container 700 and a second axis 774 corresponding to a depth of the ammunition container 700.

Like the ammunition container 500 of FIG. 17, stacking stability for the ammunition container 700 is provided by including recesses that extend along each of the first axis 772 and the second axis 774. More specifically, the lid 704 defines each of a recess 748 extending along the first axis 772 and a recess 750 extending along the second axis 774. Similarly, the second lid 708 defines a recess 752 extending along the first axis 772 and a recess 754 extending along the second axis 774. Accordingly, the recesses 748-754 extend along and providing stability and support along each of the first axis 772 and the second axis 774. The recesses 748-754 are also distributed to reduce or resist torsional forces on the ammunition container 700 when stacked. More specifically, recesses 748 and 754 are positioned along opposite edges 792, 794 of the ammunition container, which, as illustrated in FIG. 19, generally correspond to the front and rear edges of the ammunition container 700.

As a final, non-limiting example, to FIG. 19 is a top view of an ammunition container 800 is provided. Like the previously discussed examples, the ammunition container 800 includes multiple compartment portions, with each compartment portion including a compartment 802, 806 with a respective lid 804, 808. When closed, the lids 804, 808 collectively define a top surface 876 of the ammunition container 800. The top surface 876 of the ammunition container 800 is substantially rectangular and generally extends along a first axis 872 corresponding to a width of the ammunition container 800 and a second axis 874 corresponding to a depth of the ammunition container 800.

Similar to the L-shaped recesses of the ammunition container 100, stacking stability is provided in the ammunition container 800 through the use of multi-segment recesses 848, 850 defined by the lids 804, 808. In particular, the recesses 848, 850 are "plus"- or "cross"-shaped recesses formed by intersecting recess segments. For example, the recess 848 includes a first segment 849A extending along the first axis 872 and a second segment 849B extending along the second axis 874 and intersecting the first segment 849A. Similarly, the recess 850 includes a first segment 851A extending along the first axis 872 and a second segment 851B extending along the second axis 874 and intersecting the first segment 851A. Accordingly, the first segments 849A, 851A of the recesses 848, 850 generally provide improved stability and reduced movement in the direction of the second axis 874 while the second segments 849B, 851B provide improved stability and reduced movement in the direction of the first axis 872.

It should be understood that implementations of ammunition containers in accordance with the present disclosure are not limited to the specific configurations of recesses and feet discussed above. For example, any of the foregoing arrangements or configurations of recesses and feet may be combined, in whole or in part. Similarly, while the foregoing examples include specific numbers, positions, sizes, and orientations of recesses and feet, it should be understood that the present disclosure encompasses variations of the disclosed examples including, but not limited to, implementations having more or fewer recesses/feet (e.g., one or more recesses/feet per compartment portion), different locations of the recesses/feet (e.g., recesses/feet disposed in the corners of the ammunition container, recesses/feet disposed at the center of the compartment portions, recesses/feet disposed at midpoints along the edges of the compartment portions, etc.), recesses/feet that are smaller or larger than those illustrated (including those having equal lengths and widths, or other non-rectangular shapes), recesses/feet that are rotated or otherwise have modified orientations relative to those illustrated, and the like.

Moreover, it should be understood that implementations of the present disclosure may include additional features to improve performance of the ammunition containers when stacked. For example, and without limitation, ammunition containers in accordance with the present disclosure may include additional feet, protrusions, or similar features extending from their underside. While not received by a corresponding recess when stacked, such features of an upper ammunition container may nevertheless abut or otherwise interact with the top surface of a lower ammunition container during stacking to improve overall stability when stacked.

Described above are implementations of an ammunition container. While multiple implementations are disclosed, still other implementations of the presently disclosed technology will become apparent to those skilled in the art from the foregoing detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

It is believed that the present disclosure and many of its attendant advantages will be understood by the foregoing description, and it will be apparent that various changes may be made in the form, construction, and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined differently in various embodiments of the disclosure or described with different terminology. These and other variations, modifications, additions, and improvements may fall within the scope of the disclosure as defined in the claims that follow.

What is claimed is:

1. An ammunition container comprising:

a first container portion comprising a first compartment and a first lid coupled to the first compartment by a first hinge;

a second container portion comprising a second compartment and a second lid coupled to the second compartment by a second hinge, the second lid independently movable from the first lid, wherein the first container portion and the second container portion collectively define a first surface of the ammunition container and, when closed, the first lid and the second lid collectively define a second surface of the ammunition container;

a first divider wall extending and recessed between the first container portion and the second container portion to define a first vertical channel open on a first side of the ammunition container and a second divider wall extending and recessed between the first container portion and the second container portion to define a second vertical channel open on a second side of the ammunition container opposite the first side;

a handle vertically translatable between an extended position and a retracted position, the handle comprising:

a first vertical handle extension comprising a first upper vertical handle portion, a first lower vertical handle portion disposed below and inward of the first upper vertical handle portion, and a first projection extending inwardly from the first lower vertical handle portion, the first projection extending through and slidingly coupling to the first divider wall;

a second vertical handle extension comprising a second upper vertical handle portion, a second lower vertical handle portion disposed below and inward of the second upper vertical handle portion, and a second projection extending inwardly from the second lower vertical handle portion, the second projection extending through and slidingly coupling the handle to the second divider wall; and a handle top portion extending laterally between the first upper vertical handle portion and the second upper vertical handle portion, wherein, when the handle is in each of the retracted position and the extended position, the first lower vertical handle portion is disposed within the first vertical channel and the second lower vertical handle portion is disposed within the second vertical channel such that each of the first lower vertical handle portion and the second lower vertical handle portion abut each of the first container portion and the second container portion;

a recess extending from the second surface of the ammunition container into one of the first lid and the second lid, wherein the recess is L-shaped; and a foot protruding from the first surface, wherein the foot is L-shaped and located on the second surface such that a foot of a second ammunition container is receivable within the recess when the second ammunition container is stacked on the ammunition container.

2. The ammunition container of claim 1, wherein:

the recess is one of a plurality of recesses extending from the second surface of the ammunition container below the second surface of the ammunition container and the foot is one of a plurality of feet protruding from the first surface, and wherein each recess of the plurality of recesses is shaped and positioned such that each foot of a plurality of feet of a second ammunition container may be inserted into a respective recess of the plurality of recesses to stack the second ammunition container on top of the ammunition container.

3. The ammunition container of claim 2, wherein:

the second surface of the ammunition container is substantially rectangular and includes four corners, the plurality of recesses comprises four recesses, and each of the four recesses is disposed at a respective corner of the second surface.

4. The ammunition container of claim 2, wherein:

the second surface of the ammunition container extends along each of a width of the ammunition container and a depth of the ammunition container, the width being perpendicular to the depth, and each of the plurality of recesses comprises a first segment extending along the width of the ammunition container and a second segment perpendicular to the first segment and extending along the depth of ammunition container.

5. The ammunition container of claim 2, wherein:

the second surface of the ammunition container extends along each of a width of the ammunition container and a depth of the ammunition container, the width being perpendicular to the depth, a first recess of the plurality of recesses extends along the width of the ammunition container, and a second recess of the plurality of recesses that is different than the first recess extends along the depth of the ammunition container.

6. The ammunition container of claim 1, wherein:

the second surface of the ammunition container extends along each of a width of the ammunition container and a depth of the ammunition container, the width being perpendicular to the depth, and the recess comprises a first segment extending along the width of the ammunition container and a second segment extending along the depth of the ammunition container and in communication with the first segment.

7. The ammunition container of claim 1, wherein:

the recess has a recess length and a recess width, the recess length being perpendicular to and greater than the recess width, the foot has a foot length and a foot width, the foot length being perpendicular to and greater than the foot width, and the recess length is from and including about 5 percent to and including about 15 percent longer than the foot length.

8. The ammunition container of claim 1, wherein:

the recess has a recess length and a recess width, the recess width being perpendicular to the recess length, the recess length is from and including about 0.75 inches to and including about 1.25 inches, the recess width is from and including about 0.25 inches to and including about 0.35 inches, the foot has a foot length and a foot width, the foot width being perpendicular to and less than the foot length, the foot length is from and including about 0.7 inches to and including about 1.2 inches but less than the recess length, and the foot width is from and including about 0.2 inches to and including about 0.3 inches but less than the recess width.

9. The ammunition container of claim 1, wherein:

the recess has a recess length and a recess width, the recess width being perpendicular to the recess length, the foot has a foot length and a foot width, the foot width being perpendicular to and less than the foot length, the recess length is from and including 0.05 inches to and including 0.15 inches longer than the foot length, and the recess width is from and including about 0.05 to and including about 0.1 inches wider than the foot width.

10. The ammunition container of claim 1, wherein:

the recess is a first recess defined by the first lid, and the ammunition container further comprises a second recess defined by the second lid.

11. The ammunition container of claim 1, wherein the second surface of the ammunition container has an outer extent and the recess is disposed entirely within the outer extent of the second surface.

12. An ammunition container comprising:

a first compartment portion comprising:

a first compartment comprising a first compartment bottom;

a first foot extending from the first compartment bottom; and a first movable lid coupled to the first compartment and defining a first recess extending into the first movable lid;

a second compartment portion adjacent the first compartment portion, the second compartment portion comprising:

a second compartment comprising a second compartment bottom;

a second foot extending from the second compartment bottom; and a second movable lid coupled to the second compartment and independently movable from the first movable lid, the second movable lid defining a second recess extending into the second movable lid;

a first divider wall extending and recessed between the first compartment portion and the second compartment portion to define a first vertical channel open on a first side of the ammunition container and a second divider wall extending and recessed between the first compartment portion and the second compartment portion to define a second vertical channel open on a second side of the ammunition container opposite the first side; and a handle vertically translatable between an extended position and a retracted position, the handle comprising:

a first vertical handle extension comprising a first upper vertical handle portion, a first lower vertical handle portion disposed below and inward of the first upper vertical handle portion, and a first projection extending inwardly from the first lower vertical handle portion, the first projection extending through and slidingly coupling to the first divider wall;

a second vertical handle extension comprising a second upper vertical handle portion, a second lower vertical handle portion disposed below and inward of the second upper vertical handle portion, and a second projection extending inwardly from the second lower vertical handle portion, the second projection extending through and slidingly coupling the handle to the second divider wall; and a handle top portion extending laterally between the first upper vertical handle portion and the second upper vertical handle portion, wherein:

when the handle is in each of the retracted position and the extended position, the first lower vertical handle portion is disposed within the first vertical channel and the second lower vertical handle portion is disposed within the second vertical channel such that each of the first lower vertical handle portion and the second lower vertical handle portion abut each of the first compartment portion and the second compartment portion, each of the first foot and the second foot is L-shaped and is receivable by at least one of the first recess and the second recess, and each of the first recess and the second recess are L-shaped and positioned such that a first foot of a second ammunition container is receivable by one of the first recess and the second recess of the ammunition container and a second foot of the second ammunition container is receivable by the other of the first recess and the second recess of the ammunition container when the second ammunition container is stacked on the ammunition container.

13. The ammunition container of claim 12, wherein:

when closed, the first movable lid and the second movable lid define a surface of the ammunition container, the surface having an outer extent, and each of the first recess and the second recess is disposed entirely within the outer extent of the surface.

14. The ammunition container of claim 12, wherein:

when closed, the first movable lid and the second movable lid define a surface of the ammunition container, the surface of the ammunition container extends along each of a width of the ammunition container and a depth of the ammunition container, the width being perpendicular to the depth, and the first recess comprises a first segment extending along the width of the ammunition container and a second segment perpendicular to the first segment and extending along the depth of ammunition container.

15. The ammunition container of claim 12, wherein:

when closed, the first movable lid and the second movable lid define a surface of the ammunition container, the surface of the ammunition container extends along each of a width of the ammunition container and a depth of the ammunition container, the width being perpendicular to the depth, and the first recess extends along the width of the ammunition container and at least one of the second recess defined by the second movable lid or a third recess defined by the first movable lid extends along the depth of the ammunition container.

16. The ammunition container of claim 12, wherein:

when closed, the first movable lid and the second movable lid define a surface of the ammunition container, the ammunition container further comprises a vertically translatable handle disposed between the first compartment portion and the second compartment portion, the vertically translatable handle comprising a top handle surface and movable between a retracted and extended position, and when in the retracted position, the vertically translatable handle is disposed at or below the surface of the ammunition container.

17. An ammunition container comprising:

a first compartment portion comprising a first movable lid;

a second compartment portion adjacent to and coupled to the first compartment portion, the second compartment portion comprising a second movable lid;

a first divider wall extending and recessed between the first compartment portion and the second compartment portion to define a first vertical channel open on a first side of the ammunition container and a second divider wall extending and recessed between the first compartment portion and the second compartment portion to define a second vertical channel open on a second side of the ammunition container opposite the first side;

a handle vertically translatable between an extended position and a retracted position, the handle comprising:

a first vertical handle extension comprising a first upper vertical handle portion, a first lower vertical handle portion disposed below and inward of the first upper vertical handle portion, and a first projection extending inwardly from the first lower vertical handle portion, the first projection extending through and slidingly coupling to the first divider wall;

a second vertical handle extension comprising a second upper vertical handle portion, a second lower vertical handle portion disposed below and inward of the second upper vertical handle portion, and a second projection extending inwardly from the second lower vertical handle portion, the second projection extending through and slidingly coupling the handle to the second divider wall; and a handle top portion extending laterally between the first upper vertical handle portion and the second upper vertical handle portion, a plurality of L-shaped feet extending from a bottom of the ammunition container, wherein:

when the handle is in each of the retracted position and the extended position, the first lower vertical handle portion is disposed within the first vertical channel and the second lower vertical handle portion is disposed within the second vertical channel such that each of the first lower vertical handle portion and the second lower vertical handle portion abut each of the first compartment portion and the second compartment portion, the first movable lid and the second movable lid define a surface of the ammunition container that is substantially rectangular and includes an outer extent, and define a plurality of L-shaped recesses, the first movable lid comprising a first corner and a second corner of the surface and the second movable lid comprising a third corner and a fourth corner of the surface, the first movable lid defines a first L-shaped recess of the plurality of L-shaped recesses disposed in the first corner and a second L-shaped recess of the plurality of L-shaped recesses disposed in the second corner, each of the first L-shaped recess and the second L-shaped recess being disposed within the outer extent of the surface and extending into the first movable lid, the second movable lid defines a third L-shaped recess of the plurality of L-shaped recesses disposed in the third corner and a fourth L-shaped recess of the plurality of L-shaped recesses disposed in the fourth corner, each of the third L-shaped recess and the fourth L-shaped recess disposed within the outer extent of the surface and extending below the surface, and each of the plurality of L-shaped feet are shaped and positioned such that each of a plurality of L-shaped feet of a second ammunition container is receivable within a respective one of plurality of L-shaped recesses when the second ammunition container is stacked on the ammunition container.

* * * * *